US011566783B1

(12) United States Patent
Vaughn

(10) Patent No.: US 11,566,783 B1
(45) Date of Patent: Jan. 31, 2023

(54) ILLUMINATED FLAGPOLE ASSEMBLIES AND FLAG MOUNTING SYSTEMS

(71) Applicant: Randall Vaughn, Atlanta, GA (US)

(72) Inventor: Randall Vaughn, Atlanta, GA (US)

( * ) Notice: Subject to any disclaimer, the term of this patent is extended or adjusted under 35 U.S.C. 154(b) by 0 days.

(21) Appl. No.: 17/741,830

(22) Filed: May 11, 2022

Related U.S. Application Data

(63) Continuation of application No. 17/487,759, filed on Sep. 28, 2021, now Pat. No. 11,339,962.

(51) Int. Cl.

| | |
|---|---|
| ***F21V 33/00*** | (2006.01) |
| ***F21S 8/08*** | (2006.01) |
| ***F21V 21/005*** | (2006.01) |
| ***F21V 23/06*** | (2006.01) |
| ***E04H 12/32*** | (2006.01) |

(52) U.S. Cl.
CPC ..... *F21V 33/00* (2013.01); *E04H 12/32* (2013.01); *F21S 8/085* (2013.01); *F21V 21/005* (2013.01); *F21V 23/06* (2013.01)

(58) Field of Classification Search
CPC ..... F21V 33/00; F21V 21/005; F21V 23/06; F21S 8/085; E04H 12/32
See application file for complete search history.

(56) References Cited

U.S. PATENT DOCUMENTS

| | | | |
|---|---|---|---|
| 1,256,232 | A | 2/1918 | Howard |
| 7,303,453 | B1 | 12/2007 | Bourke |
| 11,009,199 | B2 | 5/2021 | Gallo, Jr. |
| 2002/0159252 | A1 | 10/2002 | Kasina |
| 2005/0028415 | A1 | 2/2005 | Rodriguez |
| 2006/0023446 | A1 | 2/2006 | Racoosin |
| 2006/0109651 | A1 | 5/2006 | Cocciardi |
| 2007/0068444 | A1 | 3/2007 | Ciaccia |
| 2008/0001046 | A1 | 1/2008 | Mettler et al. |
| 2009/0290365 | A1 | 11/2009 | Schroeder |

(Continued)

FOREIGN PATENT DOCUMENTS

| | | | |
|---|---|---|---|
| KR | 20140038835 | A | 3/2014 |
| KR | 101685308 | B1 | 12/2016 |

OTHER PUBLICATIONS

International Search Report and Written Opinion in related PCT Application No. PCT/US2022/026126, dated May 17, 2022 (7 pages).

*Primary Examiner* — Anabel Ton
(74) *Attorney, Agent, or Firm* — Troutman Pepper Hamilton Sanders LLP; John A. Morrissett; Aaron E. Johnston

(57) ABSTRACT

Systems and devices for providing an illuminated flagpole assembly are disclosed. The assembly can include a hoist end member configured to be attached to a flagpole, a fly end member aligned in parallel with and opposite the hoist end member, an upper cross member, and a lower cross member. The upper cross member and lower cross member may each be formed of a respective plurality of links. Each plurality of links may be connected to one or more adjacent links and aligned along a plane. A first link of each of the plurality of links may be connected to the hoist end member and a second link of each of the plurality of links may be connected to the fly end member. Each link of the each of the plurality of links can be configured to swivel with respect to one or more adjacent links.

20 Claims, 23 Drawing Sheets
(1 of 23 Drawing Sheet(s) Filed in Color)

(56) References Cited

U.S. PATENT DOCUMENTS

| | | | | |
|---|---|---|---|---|
| 2012/0017822 | A1 | 1/2012 | Bort | |
| 2012/0318189 | A1 | 12/2012 | Oyoung | |
| 2014/0301083 | A1 | 10/2014 | Cobane | |
| 2016/0063904 | A1 | 3/2016 | Heath et al. | |
| 2018/0313108 | A1 | 11/2018 | Ciaccia | |
| 2019/0073900 | A1* | 3/2019 | Colbert | G09F 17/00 |

* cited by examiner

ILLUMINATED FLAGPOLE ASSEMBLIES AND FLAG MOUNTING SYSTEMS

CROSS REFERENCE TO RELATED APPLICATIONS

This application is a continuation of, and claims priority under 35 U.S.C. § 120 to, U.S. patent application Ser. No. 17/487,759, filed Sep. 28, 2021, the entire contents of which are fully incorporated herein by reference.

FIELD OF INVENTION

Examples of the present disclosure relate to systems and devices for providing an illuminated flagpole assembly. More particularly, an illuminated flagpole and flag frame system are disclosed herein.

BACKGROUND

Many consumers and businesses use flags mounted on flagpoles for a variety of reasons, including advertising, promotions, displaying sports team flags, national flags, and/or state flags. A known drawback of traditional flagpole assemblies is the lack of visibility of a mounted flags in low light conditions, such as at night.

Accordingly, there is a need for systems and devices for providing an illuminated flagpole assembly. Examples of the present disclosure are directed to this and to other considerations.

SUMMARY

Examples of the present disclosure relate to systems and devices for providing an illuminated flagpole assembly.

Consistent with the disclosed embodiments, various systems and devices are disclosed. In one aspect, an illuminated flagpole assembly is disclosed. The flagpole assembly may include a flag frame, which may include a hoist end member, a fly end member, an upper cross member, and a lower cross member. The hoist end member may be configured to be selectively attached to a flagpole. The fly end member may be aligned in parallel with and opposite to the hoist end member. The upper cross member may be formed by a first plurality of links. Each of the first plurality of links may be connected to and configured to swivel relative to one or more adjacent links of the first plurality of links. The first plurality of links may be aligned along a first plane. A first link may of the first plurality of links may be connected to the hoist end member and a second link of the first plurality of links may be connected to the fly end member. Each link of the first plurality of links may include a housing. The flag frame may additionally include a first plurality of light elements. Each of the first plurality of light elements may have at least a portion of each respective light element in a housing of a respective link of the first plurality of links. The lower cross member may be formed by a second plurality of links. Each link of the second plurality of links may be connected to and configured to swivel relative to one or more adjacent links of the second plurality of links. The second plurality of links may be aligned along a second plane that is parallel to the first plane. A first link of the second plurality of links may be connected to the hoist end member and a second link of the second plurality of links may be connected to the fly end member. Each of the second plurality of links may include a housing. The flag frame may additionally include a second plurality of light elements. Each of the second plurality of light elements may have at least a portion of each respective light element in a housing of a respective link of the second plurality of links.

In another aspect, an illuminated flagpole assembly is disclosed. The illuminated flagpole assembly may include a flag frame, and the flag frame may include a hoist end member, a fly end member, an upper cross member, a first plurality of light elements, a lower cross member, and a second plurality of light elements. The fly end member may be positioned opposite the hoist end member. The upper cross member may be attachable to the hoist end member at a first end and to the fly end member at a second end. The upper cross member may be formed by a first plurality of links that may be aligned along a first plane. Each of the first plurality of links may be attachable and configured to rotate in the first plane relative to one or more adjacent links of the first plurality of links. The first plurality of light elements may each be attachable to a respective link of the first plurality of links. The lower cross member may be attachable to the hoist end member at a first end and to the fly end member at a second end. The lower cross member may be formed by a second plurality of links which may be aligned along a second plane that is parallel to the first plane. Each of the second plurality of links may be attachable and configured to rotate in the second plane relative to one or more adjacent links of the second plurality of links. The second plurality of light elements may each be attachable to a respective link of the second plurality of links.

In another aspect, an illuminated flagpole assembly is disclosed. The illuminated flagpole assembly may include a flag frame, and the flag frame may include a hoist end member, a fly end member, an upper cross member, a first plurality of light elements, a lower cross member, and a second plurality of light elements. The fly end member may be positioned opposite the hoist end member. The upper cross member may be attachable to the hoist end member at a first end and to the fly end member at a second end. The upper cross member may include a first plurality of links. The first plurality of links may each be connected to one or more adjacent links of the first plurality of links. The first plurality of links may be aligned along a first plane and configured to swivel with respect to one or more adjacent links of the first plurality of links. The first plurality of light elements may each be attachable to a respective link of the first plurality of links. The lower cross member may be attachable to the hoist end member at a first end and to the fly end member at a second end. The lower cross member may include a second a plurality of links. The second plurality of links may each be connected to one or more adjacent links of the second plurality of links. The second plurality of links may be aligned along a second plane parallel to the first plane and configured to swivel with respect to one or more adjacent links of the second plurality of links. The second plurality of light elements may each be attachable to a respective link of the second plurality of links.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale, are incorporated into, and constitute a portion of, this disclosure, illustrate various implementations and aspects of the disclosed technology and, together with the description, serve to explain the principles of the disclosed technology. In the drawings.

DETAILED DESCRIPTION

Some implementations of the disclosed technology will be described more fully with reference to the accompanying drawings. This disclosed technology, however, may be embodied in many different forms and should not be construed as limited to the implementations set forth herein. The components described hereinafter as making up various elements of the disclosed technology are intended to be illustrative and not restrictive. Many suitable components that could perform the same or similar functions as components described herein are intended to be embraced within the scope of the disclosed systems and devices. Such other components not described herein may include, but are not limited to, for example, components developed after development of the disclosed technology. Wherever convenient, the same references numbers will be used throughout the drawings to refer to the same or like parts.

Figure 1:
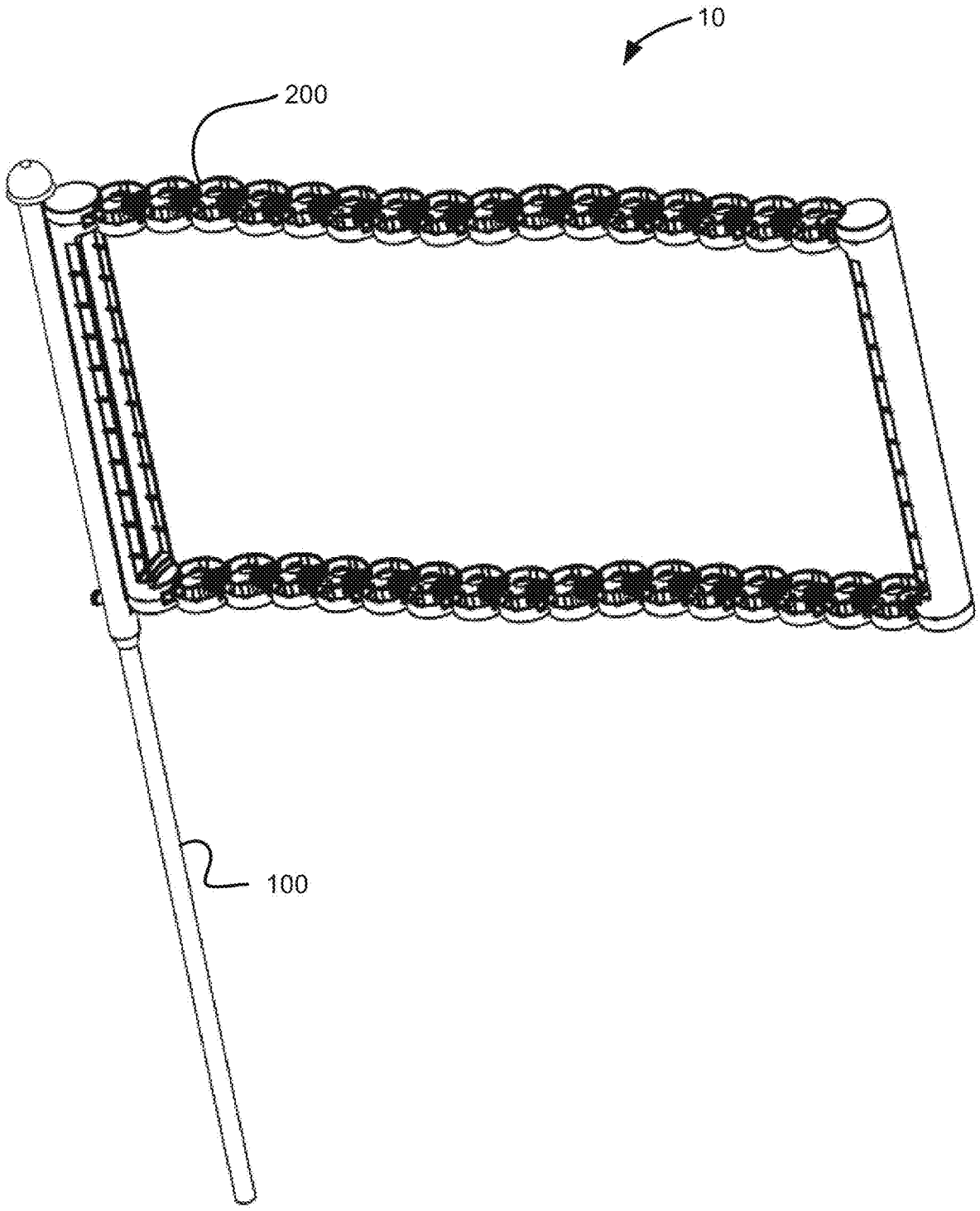
FIG. 1 is front perspective view of an exemplary flagpole assembly, in accordance with some examples of the present disclosure.

FIG. 1 is an illustration of an exemplary flagpole assembly 10. The flagpole assembly 10 may include a flagpole 100 and a flag frame 200. The flagpole 100 and flag frame 200 may be made of a metal, such as steel or aluminum. In some embodiments, the flagpole 100 and flag frame 200 may be of a composite construction, and certain components may be constructed of plastic, as will be described below. The flagpole 100 may include an attachment section 110 and an extension section 120, as described in more detail with respect to FIGS. 2A-3B. As shown in FIG. 1, the flag frame 200 may be attachable and detachable from the flagpole 100. As described in more detail with respect to FIGS. 2A-2B and FIGS. 7-8B, flag frame 200 may include a hoist end member having an attachment sleeve 214 that is configured to slot into and be secured to flagpole 100. As described in more detail with respect to FIG. 7, flag frame 200 may be constructed of a hoist end member (e.g., hoist end member 210), and a fly end member (e.g., fly end member 230). Hoist end member and fly end member may be connected by a plurality of links (e.g., swivel links 250, as described in more detail with respect to FIG. 7), across the top of flag frame 200, and also across the bottom of flag frame 200. According to some embodiments, each of the plurality of links may include a watertight housing that is capable of swiveling with respect to an adjacent link. Each of the plurality of links may also include one or more lights within the water-tight housing, so that when the flagpole assembly 10 is in an assembled configuration, the lights contained with the watertight housings may illuminate a flag attached to flag frame 200. Further details of the flagpole assembly will be described with respect to the following figures.

Figure 2B:
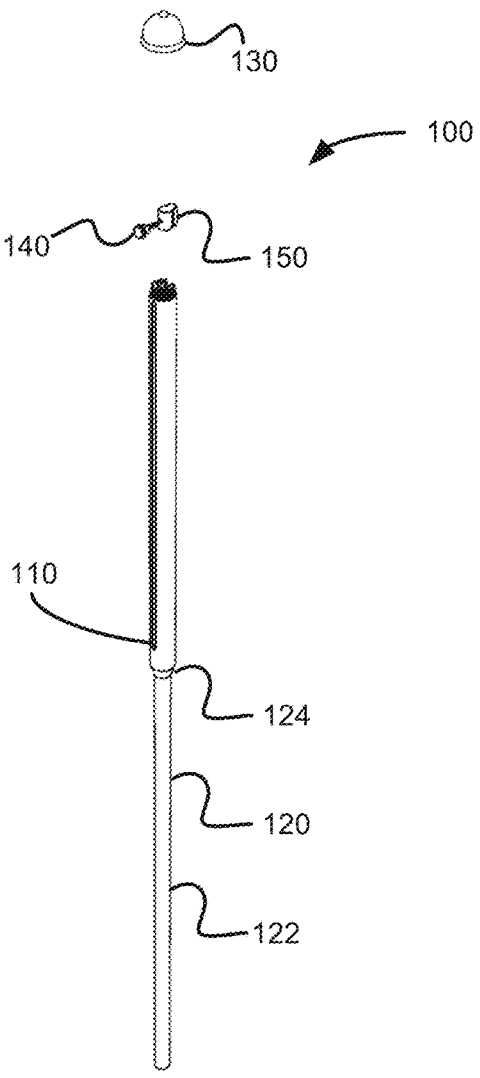
FIGS. 2A-2B show an exemplary flagpole in a front isometric view (FIG. 2A) and an exploded view (FIG. 2B), in accordance with some examples of the present disclosure.
Figure 2A:
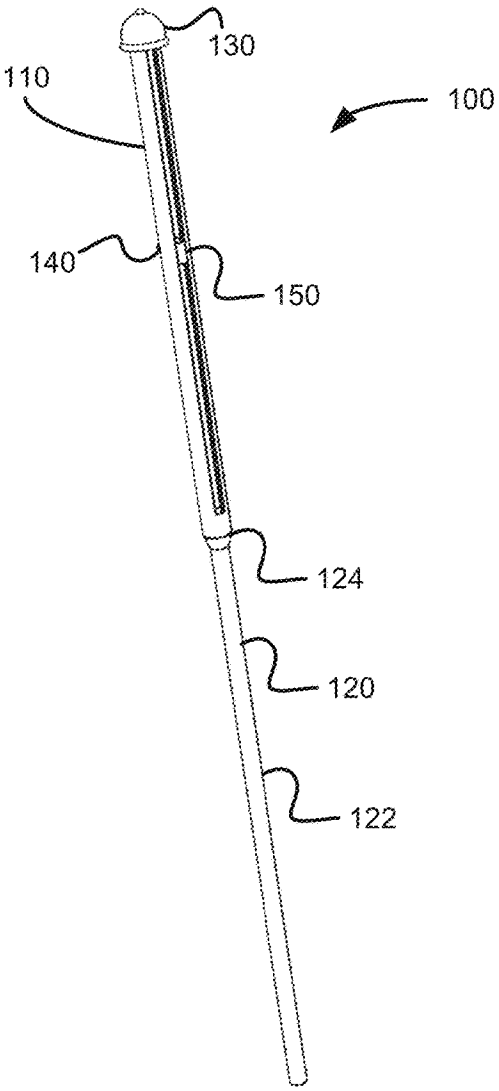

FIGS. 2A-2B are illustrations of flagpole 100, in accordance with some examples of the present disclosure. FIG. 2A shows flagpole 100 from a first perspective, and FIG. 2B shows flagpole 100 from a second perspective rotated approximately 180 degrees with respect to the perspective shown in FIG. 2A. As shown in FIGS. 2A-2B, flagpole 100 may include an extension section 120 and an attachment section 110. The extension section 120 may include a tubular body 122 and a tapered region 124 and a bottom end 126 (as shown and described with respect to FIGS. 3A-3B). A cap 130, which may be an ornament or finial, may be threaded or otherwise attached onto a top portion of the attachment section 110, and a shoulder bolt 140 and a slide fastener 150 may be at least partially disposed within an inner cavity of the attachment section 110. The attachment section 110 may be configured to attach to flag frame 200 (as described in more detail with respect to FIGS. 3A-3B). The extension section 120 may be telescoping such that, for example, at least a portion of it is insertable into the attachment section 110, thereby allowing a user of the flagpole assembly to quickly and conveniently adjust the height of the flagpole 100 to display a flag at a variety of heights, as desired.

The tubular body 122 of the extension section 120 may be made of any sufficiently strong material, such as aluminum or steel, but may also be made of a high strength composite material, such as Kevlar™ in order to reduce weight while maintaining strength. At a top portion of the tubular body 122 may be disposed a tapered regions 124. In some embodiments, the tapered region 124 may be threaded in order to provide a convenient means of attachment to the attachment section 110. In other embodiments, the tapered region 124 may be integral with the attachment section 110. The tapered region 124 is configured to securely position the flagpole assembly 10 when the flagpole 100 is attached to a piece of furniture, such as a beach chair or table. Tapered region 124 may also be configured to provide a convenient means for a user of flagpole 100 to securely grip flagpole 100 while flagpole assembly 10 is in use. In an alternative example, the tapered region 124 may be non-tapered or contoured to fit another shape (e.g., to a user's hand for improved grip).

The attachment section 110 may include a shoulder bolt 140 and slide fastener 150. As discussed in more detail with respect to FIGS. 3A-3B, the attachment section 110 may include a rear opening 116 and a front opening 118. In the example shown, the shoulder bolt 140 may extend through the rear opening 116 and be received by the slide fastener 150, though it could alternatively extend through the front opening 118 in other embodiments. Slide fastener 150 and shoulder bolt 140 may be used to attach an assembled flag frame 200 to flagpole 100, thereby forming flagpole assembly 10. In some examples, the flag frame 200 may form an interference fit such that it snaps or tightly fits into place with sufficient friction to hold it in place relative to the flagpole 100. The slide fastener 150 and shoulder bolt 140 may provide extra rigidity to hold the flagpole assembly 10 together and optionally provide a locking mechanism to help prevent theft or unwanted disassembly of the flagpole assembly 10 or assembled flag frame 200. Threaded onto a threaded top end (e.g., threaded top end 112, described in more detail with respect to FIGS. 3A-3B), is the cap 130. Cap 130 may attach to the top of the attachment section 110 of flagpole 100. Cap 130 may ensure that slide fastener 150 cannot slide off the top of attachment section 110 after it is secured to attachment section 110, and may help prevent moisture from entering the cavity of the attachment section 110.

Figure 3B:
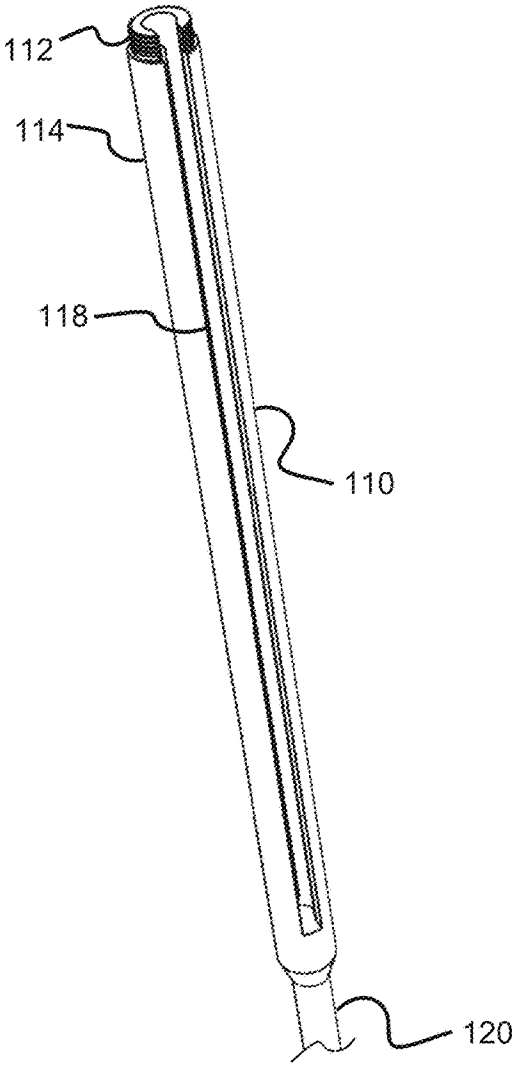
FIGS. 3A-3B show an extension section and an attachment section of the exemplary flagpole of FIGS. 2A-2B in more detail, with FIG. 3A providing a back view of the extension and attachment sections and FIG. 3B providing a front isometric view of the attachment section.
Figure 3A:
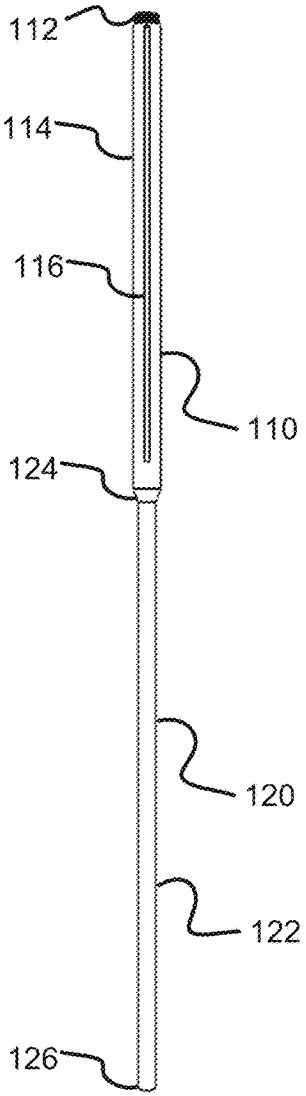

Turning to FIGS. 3A-3B, certain components of extension section 120 and attachment section 110 are shown in more detail. The extension section 120 may include a bottom end 126, which may be configured to be attached to a base or stand (not shown). In some configurations, bottom end 126 may be configured to be securely attached to the ground (e.g., by burying the bottom end 126 into the ground). Attachment section 110 may include a threaded top end 112, a hollow tubular body 114, rear opening 116, and top opening 118. Threaded top end 112 may be configured to thread onto cap 130 to securely fasten cap 130 to the attachment section 110. Tubular body 114 may be constructed of any sufficiently strong material, such as a composite, aluminum, steel, etc. Tubular body 114 may include a rear opening 116, which is configured to receive bolt 140, and a front opening 118, which is configured to receive slide fastener 150. Front opening 118 extends vertically through threaded top end 112, so that slide fastener 150 can be slide over threaded top end 112 into front opening 118, whereas rear opening 116 does not extend vertically through threaded top end 112, so shoulder bolt must be inserted through rear opening and cannot be slide over threaded top end 112.

Figure 4B:
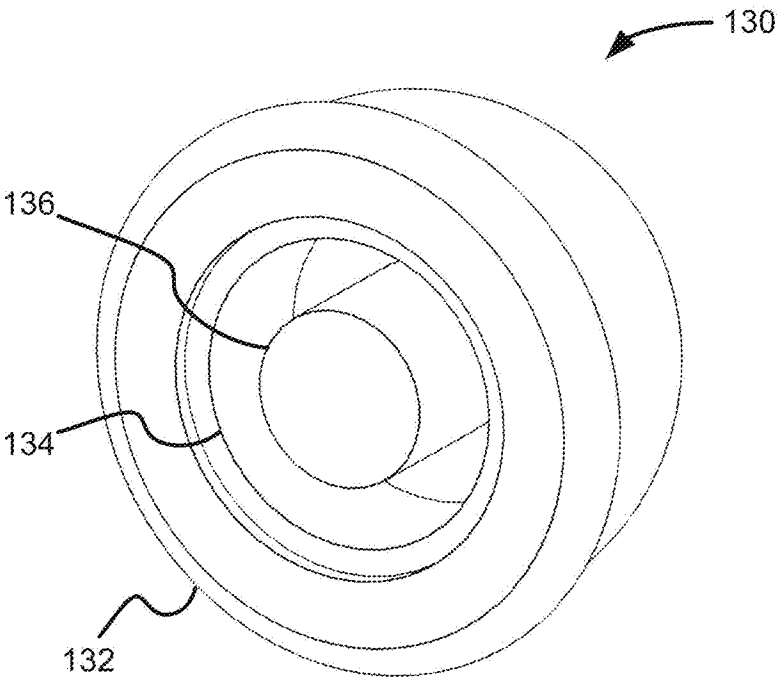
FIGS. 4A-4B show an exemplary flagpole cap in a front perspective view (FIG. 4A) and a bottom isometric view (FIG. 4B), in accordance with some examples of the present disclosure.
Figure 4A:
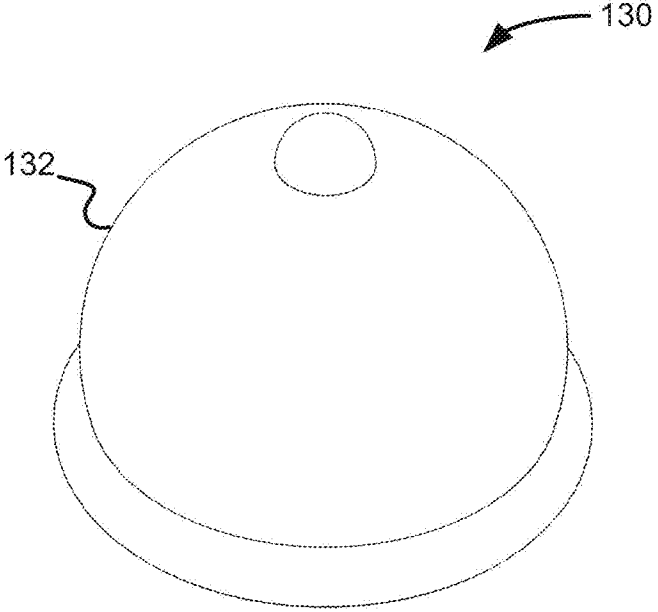

FIGS. 4A-4B illustrates cap 130 in more detail, in accordance with some examples of the present disclosure. As shown cap 130 may include an outer body 132, a rim 134, and a plug 136. Outer body 132 is generally weatherproof, and can seal the flagpole 100 from the elements, such as rain, snow, and particulates that could otherwise penetrate to an interior portion of flagpole 100. As shown in FIG. 4B, the underside of cap 130 may include rim 134 and plug 136. Rim 134 may ensure that the cap 130 is seated in the appropriate position with respect to threaded top end 112, so that cap 130 can effectively seal an interior portion of the flagpole 100. The plug 136 of cap 130 is configured to create a tight seal against threaded top end 112 of attachment section 110 and to properly seat the cap 130 within the attachment section 110 so the threads align. In some embodiments, the threaded top end 112 can be screwed into threads cut into the interior portion of plug 136, thereby allowing cap 130 to be securely affixed to the attachment section 110. The cap 130 may be bell-shaped, as shown, or take on other shapes such as a cube or decorative design. Regardless of the outer shape of cap 130, it may still employ the rim 134 and plug 136 design to help seat and seal the cap 130 to threaded top end 112.

Figure 5:
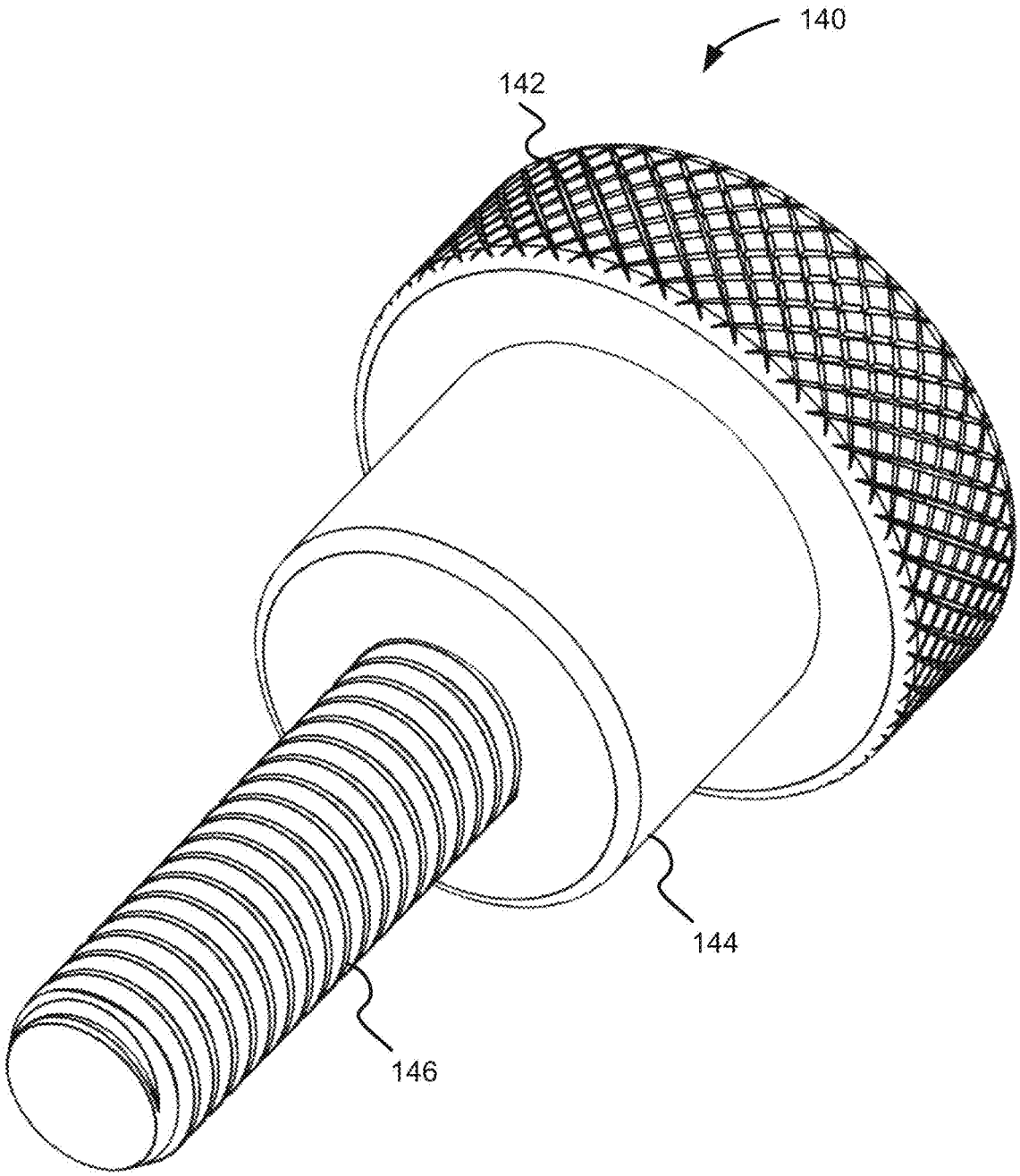
FIG. 5 shows an isometric view of a shoulder bolt, in accordance with some examples of the present disclosure.

FIG. 5 illustrates a shoulder bolt 140, in accordance with some examples of the present disclosure. As described above, the shoulder bolt 140 may be used in tandem with slide fastener 150 to attach a flag frame 200 to the attachment section 110 of flagpole 100. As shown in FIG. 5, shoulder bolt 140 can include a knob head 142, a shoulder 144, and threading 146. A user of flagpole assembly 10 can conveniently grip knob head 142 to fasten flag frame 200 to flagpole 100 by threading bolt 140 through rear opening 116 of attachment section 110 and screw bolt 140 into slide fastener 150, which is first slid through front opening 118 of attachment section 110 before threading bolt 140 into slide fastener 150. In some embodiments, knob head 142 can include a knurled or textured surface in order to improve the ease of use of shoulder bolt 140 when screwing shoulder bolt 140 into slide fastener 150. It is also contemplated that knob head 142 may include a compressible material (e.g., rubber or soft plastic) on its shoulder to allow for increased torque, thereby helping to minimize unwanted movement of the hoist end member 210 and, in turn, wear and tear.

Figure 6B:
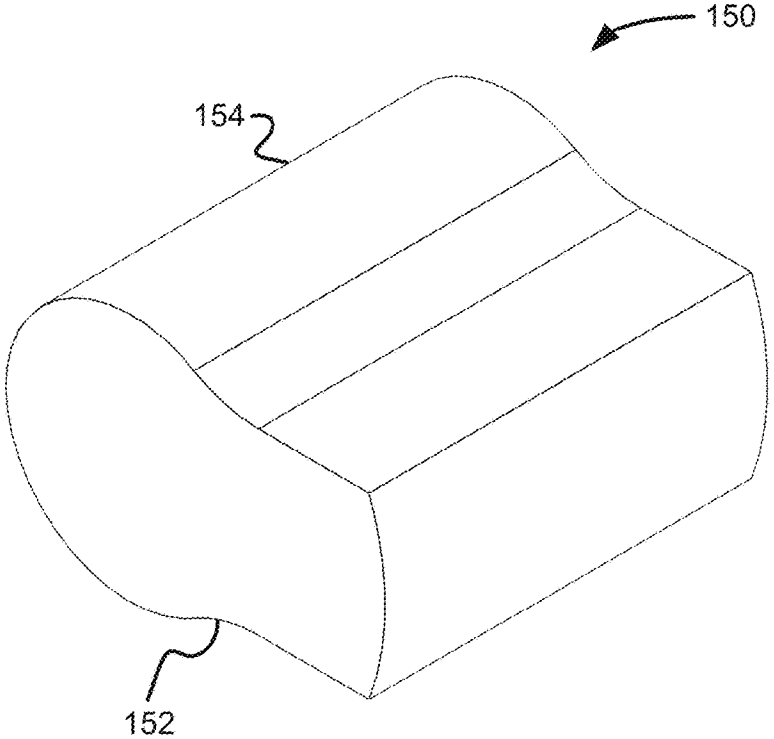
FIGS. 6A-6B show an exemplary slide fastener in a front perspective view (FIG. 2A) and a top isometric view (FIG. 2B), in accordance with some examples of the present disclosure.
Figure 6A:
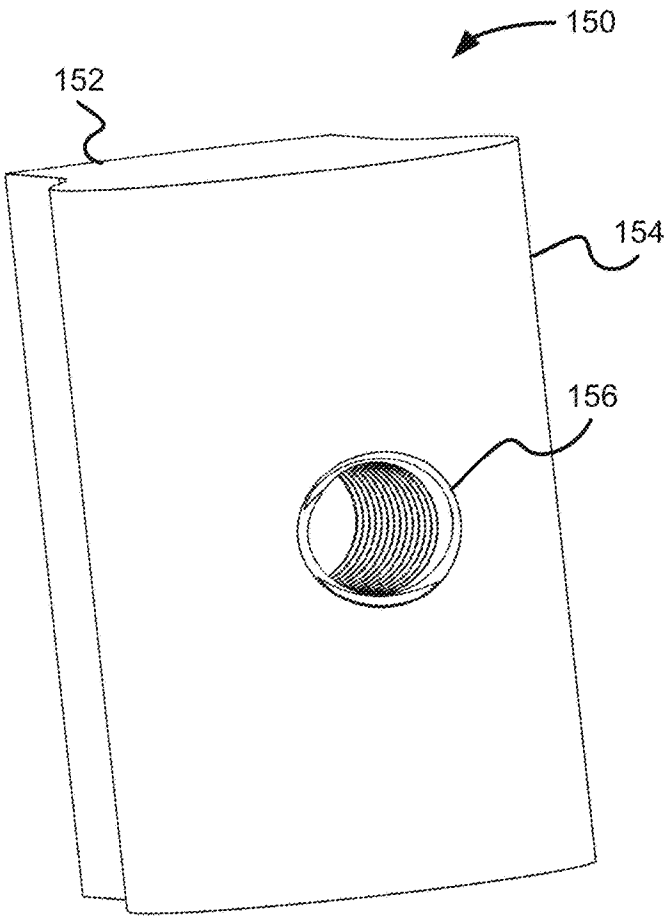

FIGS. 6A-6B are illustrations of the slide fastener 150, in accordance with some examples of the present disclosure. As shown, slide fastener 150 can include end faces 152, sidewalls 154, and threaded blind hole 156. End faces 152 and sidewalls 154 form the slide fastener 150. Located on one face of slide fastener 150 is threaded blind hole 156. Threaded blind hole 156 may extend into the body of slide fastener 150, and may not extend all the way through the body of slide fastener 150 so that threaded blind hole 156 may only be present on one face of slide fastener 150. To help align slide fastener 150 so the threaded blind hole 156 faces the proper direction to receive shoulder bolt 140, its end faces 152 may be shaped to fit within the cavity of the attachment section 110 in a single alignment as shown in FIG. 6B.

Figure 7:
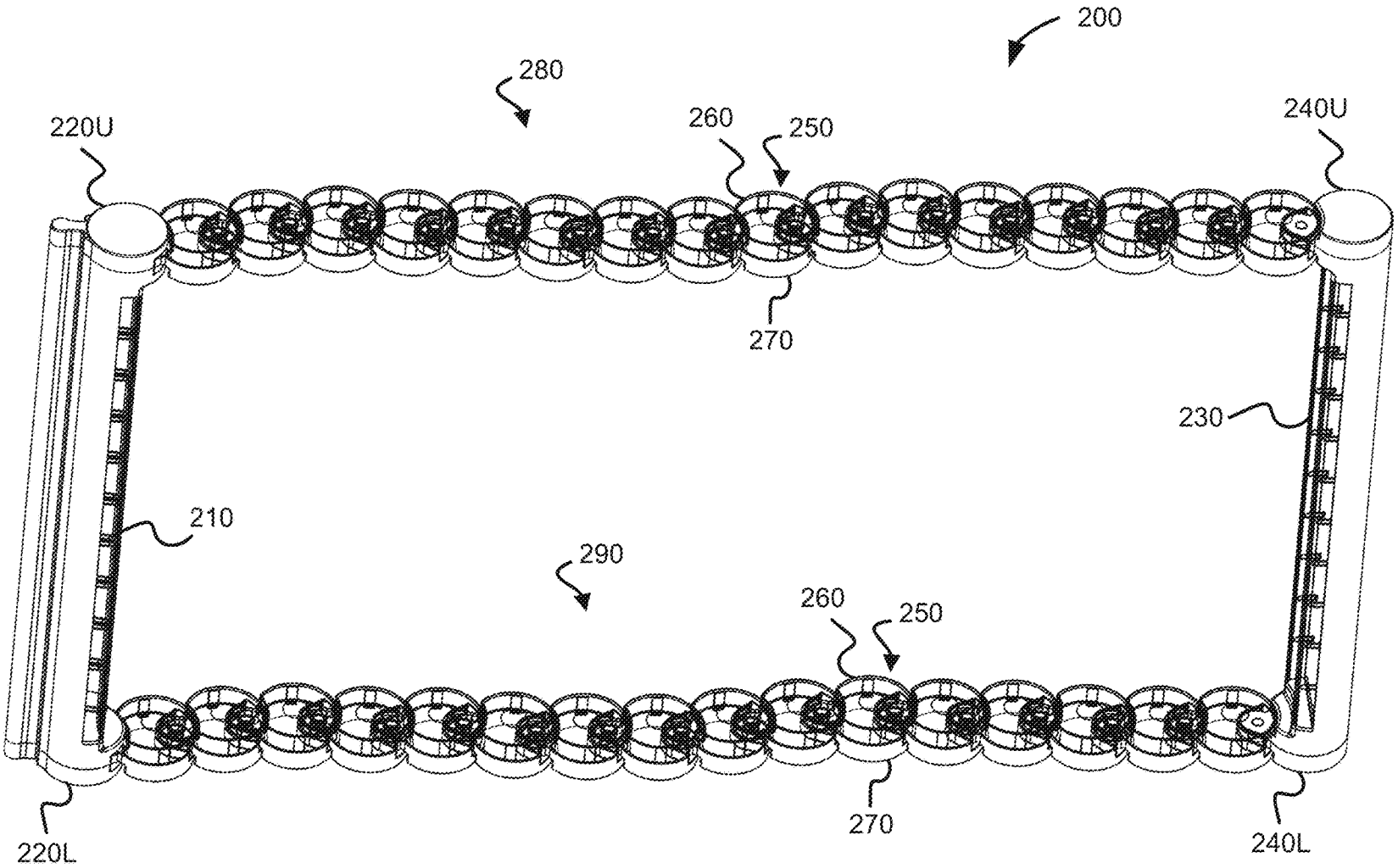
FIG. 7 shows a perspective view of an exemplary flag frame, in accordance with some examples of the present disclosure.

FIG. 7 is an illustration of flag frame 200, in accordance with some examples of the present disclosure. As shown, flag frame 200 can include a hoist end member 210, fly end member 230, upper cross member 280, lower cross member 290, upper hoist end cap 220U, lower hoist end cap 220L, upper fly end cap 240U, and lower fly end cap 240L. The hoist end member 210 can be selectively attached to attachment section 110 of flagpole 100. The fly end member 230 can be aligned in parallel with and opposite to the hoist end member 210. The upper hoist end cap 220U can be attached to an upper end of the hoist end member 210 (e.g., upper end 216, as described in more detail with respect to FIGS. 8A-8B) in order to seal the hoist end member 210 from water, dust, and other elements. The lower hoist end cap 220L similarly attaches to a lower end of hoist end member 210 in order to seal the hoist end member 210 from water, dust, and other elements. Similarly, upper fly end cap 240U can be attached to an upper end of fly end member 230 and lower fly end cap 240L can be attached to a lower end of fly end member 230, to seal fly end member 230 from the elements.

Upper cross member 280 can be formed from a chain of swivel links 250. Each swivel link 250 can be constructed of a clear upper housing 260 and an opaque lower housing 270. In some embodiments, one or more lights can be housed within the body of swivel link, sandwiched in between the clear upper housing 260 and opaque lower housing 270. Each swivel link 250 can be attached to one or more adjacent swivel link 250, and swivel links 250 are configured to swivel with respect to adjacent swivel links by approximately 10 degrees in either direction (e.g., into the page or out of the page of FIG. 7) from a first plane defined by the chain of swivel links 250 that connect an upper end of hoist end member 210 to an upper end of fly end member 230.

Lower cross member 290 can similarly be formed from a chain of swivel links 250. The swivel links 250 of lower cross member 290 can similarly swivel with respect to adjacent swivel links by approximately 10 degrees in either direction from a second plane defined by the chain of swivel links 250 that connect a lower end of hoist end member 210 to a lower end of fly end member 230.

Figure 8B:
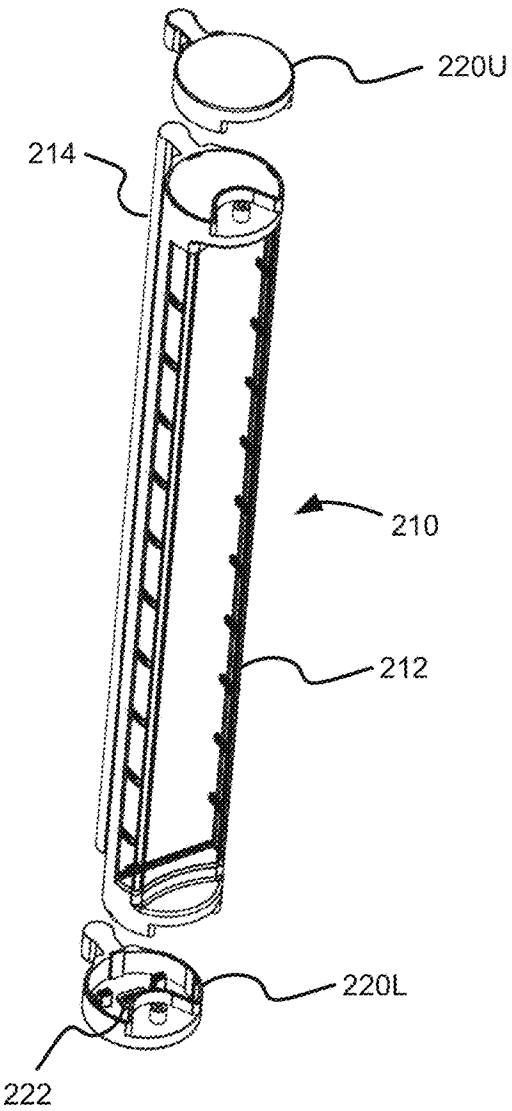
FIGS. 8A-8B show side (FIG. 8A) and front (FIG. 8A) exploded views of an exemplary hoist end member of the flag frame of FIG. 7, in accordance with some examples of the present disclosure.
Figure 8A:
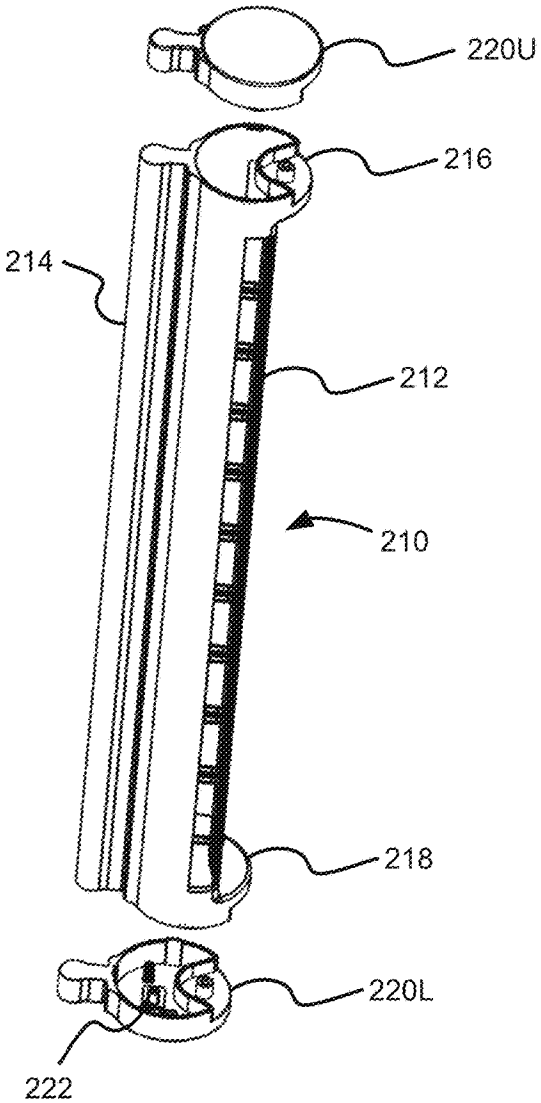

FIGS. 8A-8B are illustrations of a hoist end member of a flag frame, in accordance with some examples of the present disclosure. As shown, hoist end member 210 can include a flag facing cavity 212, an upper hoist end attachment sleeve 214, an upper end 216, and a lower end 218. The flag facing cavity 212 can be configured to attach to a flag on a first side of the flag. Hoist end attachment sleeve 214 can be configured to slide into hollow tubular body 114 of attachment section 110 to connect flag frame 200 to flagpole 100. Further, shoulder bolt 140 and slide fastener 150 can be used to maintain the position of flag frame 200 with respect to flagpole 100 once hoist end attachment sleeve 214 is attached to hollow tubular body 114 of attachment section 110. As described earlier, upper hoist end cap 220U can securely attach to upper end 216 of hoist end member 210. Similarly, lower hoist end cap 220L can securely attach to lower end 218 of hoist end member 210. Lower hoist end cap 220L and upper hoist end cap 220U can seal an interior of hoist end member 210, thereby providing resistance to moisture, rain, snow, dust, and other elements to flagpole 100. As shown, lower hoist end cap 220L can also include opening 222. Opening 222 can be configured to pass an electrical connector, such as a USB connector, that provides an electrical connection to components of hoist end member 210. The electrical connector can be used to power one or more lights (not shown) at least partially or fully disposed within flag facing cavity 212, as well as one or more lights (not shown) at least partially or fully disposed within a cavity of the swivel links 250 collectively forming the upper cross member 280 or lower cross member 290. For example, there may be a single light disposed within a majority of or substantially occupying (e.g., 80+%) and aligned down a central vertical axis of the flag facing cavity 212. In another example, there may be two lights aligned in parallel and positioned offset the central vertical axis. Similarly, each of the swivel links 250 may include a single light aligned along a central horizontal axis or two lights aligned in parallel offset the central horizontal axis. The offset pair of lights can help further illuminate both sides of the flag faces. According to some embodiments, the electrical connector can be coupled to a printed circuit board, which can provide instructions via the electrical connector that can allow a user of the flagpole assembly 10 to program the function of the lights of the flagpole assembly 10. For example, the printed circuit board can provide several different lighting functions, including solid light, flashing light, changing colors, etc. According to some embodiments, the printed circuit board may include a wireless communication chip that can allow a user of the flagpole assembly 10 to customize the lighting functions, by communicating with the printed circuit board over a wireless communication protocol, such as Bluetooth™, Bluetooth low energy (BLE), NFC, WiFi™, etc. In some embodiments, the hoist end member 210 may be further configured to receive one or more stackable links (not shown). Stackable links may be similar to swivel links 250, except they may be vertically stackable within hoist end member 210 and/or fly end member 230. As discussed with respect to swivel links 250, each stackable link may contain a light that is configured to illuminate a flag when attached to flag frame 200. In another embodiment, a single vertical link or light bar may be used in lieu of stackable links since the stackable links do not need to swivel relative to one another. The single vertical link or light bar and stackable links may house one or more lights as described with respect to the hoist end member 210 and swivel links 250, respectively.

Figure 9A:
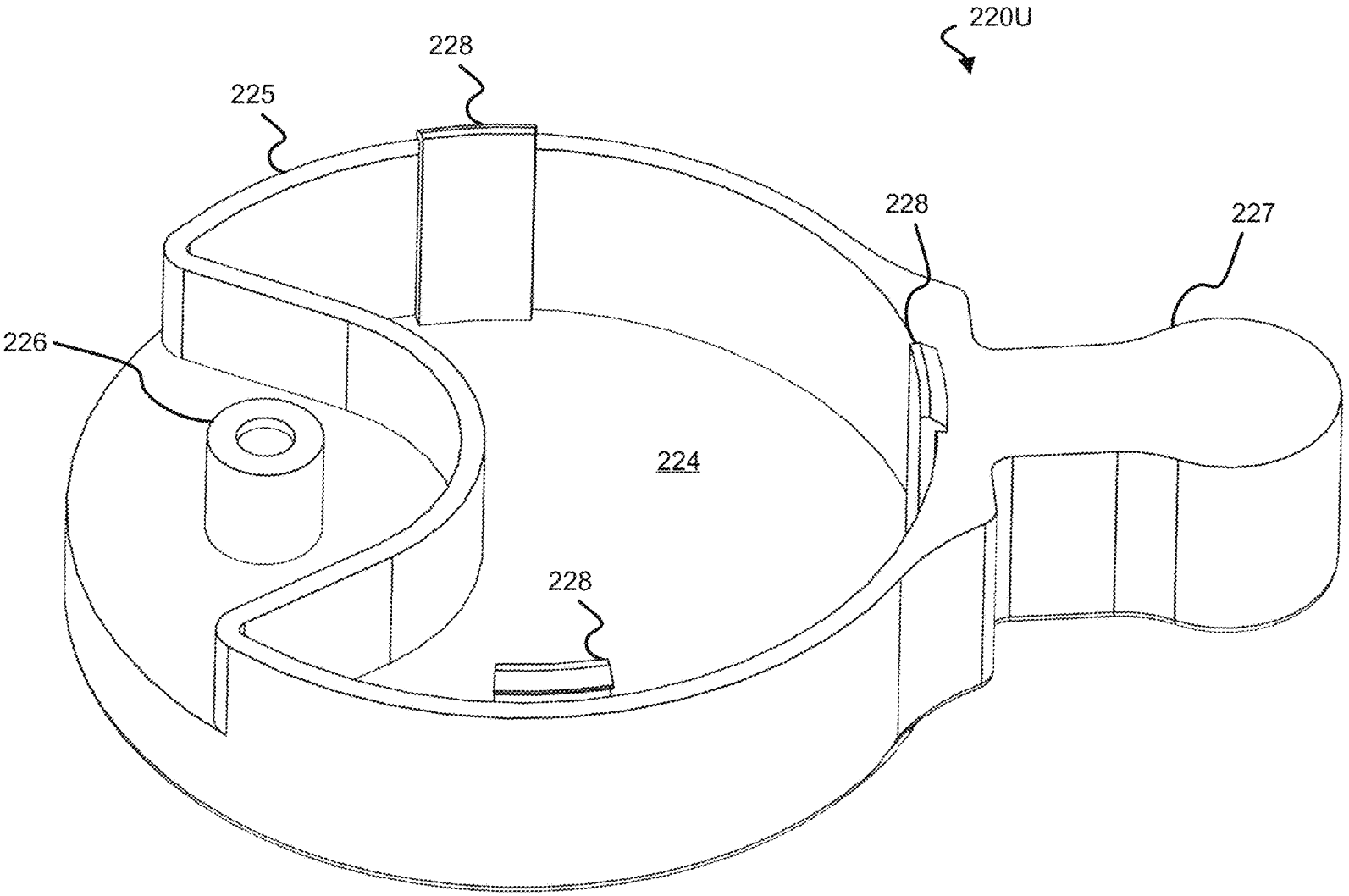
FIGS. 9A-9B show bottom (FIG. 9A) and top (FIG. 9B) perspective views of an upper hoist end cap of the hoist end member of FIGS. 8A-8B, in accordance with some examples of the present disclosure.

FIG. 9A is an illustration of a lower surface of upper hoist end cap 220U, in accordance with some examples of the present disclosure. As shown, lower surface of upper hoist end cap 220U can include a baseplate 224, a sidewall 225, a plug 226, a tongue 227, and clips 228. The lower surface of upper hoist end cap 220U can be configured to securely attach to the upper end 216 of hoist end member 210. For example, plug 226 can be configured to securely fit into (e.g., with an interference fit) with a corresponding socket disposed on the upper end 216 of hoist end member 210. To further secure upper hoist end cap 220U to upper end 216 of hoist end member 210, clips 228 may be provided that securely clip the upper hoist end cap 220U to the upper end 216. When attached to upper end 216, baseplate 224 of upper hoist end cap 220U may snugly fit against the upper end 216 of hoist end member 210. Sidewall 225 can define a hollow space of the lower surface of upper hoist end cap 220U which can interface with upper end 216 when upper hoist end cap 220U is attached to hoist end member 210. Tongue 227 of upper hoist end cap 220U functions in a similar manner to tongue 227 of the hoist end member 210. For example, tongue 227 can slide into front opening 118 of hollow tubular body 114 of attachment section 110, thereby securing upper hoist end cap 220U to flagpole 100.

Figure 9B:
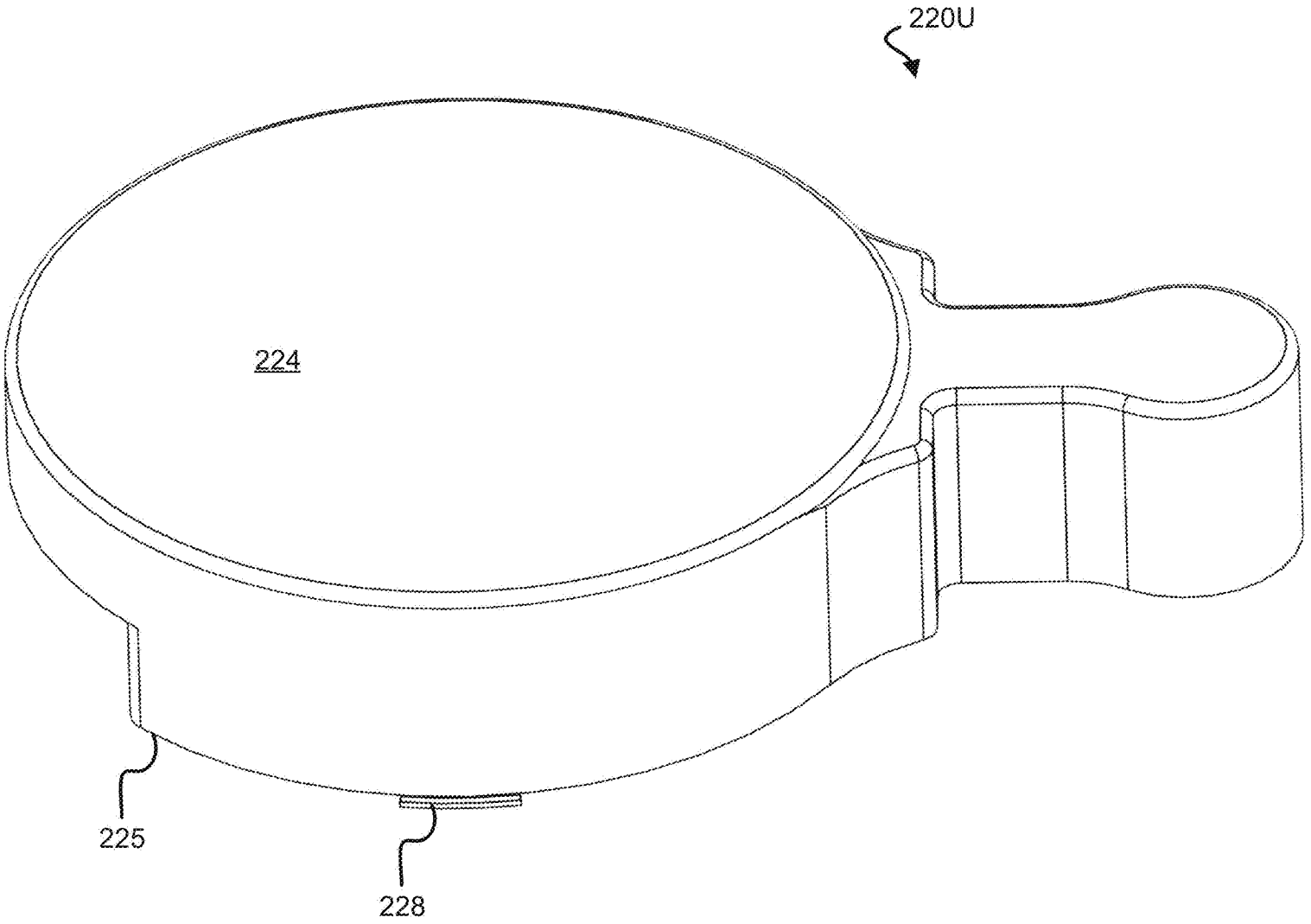

FIG. 9B is an illustration of an upper surface of upper hoist end cap 220U, in accordance with some examples of the present disclosure. As shown, the upper surface faces outwards (away from) the upper end 216 of hoist end member 210 when upper hoist end cap 220U is attached to the hoist end member 210. Baseplate 224 can seal the hoist end member 210 protecting hoist end member from elements such as ice, rain, dust, etc.

Figure 10A:
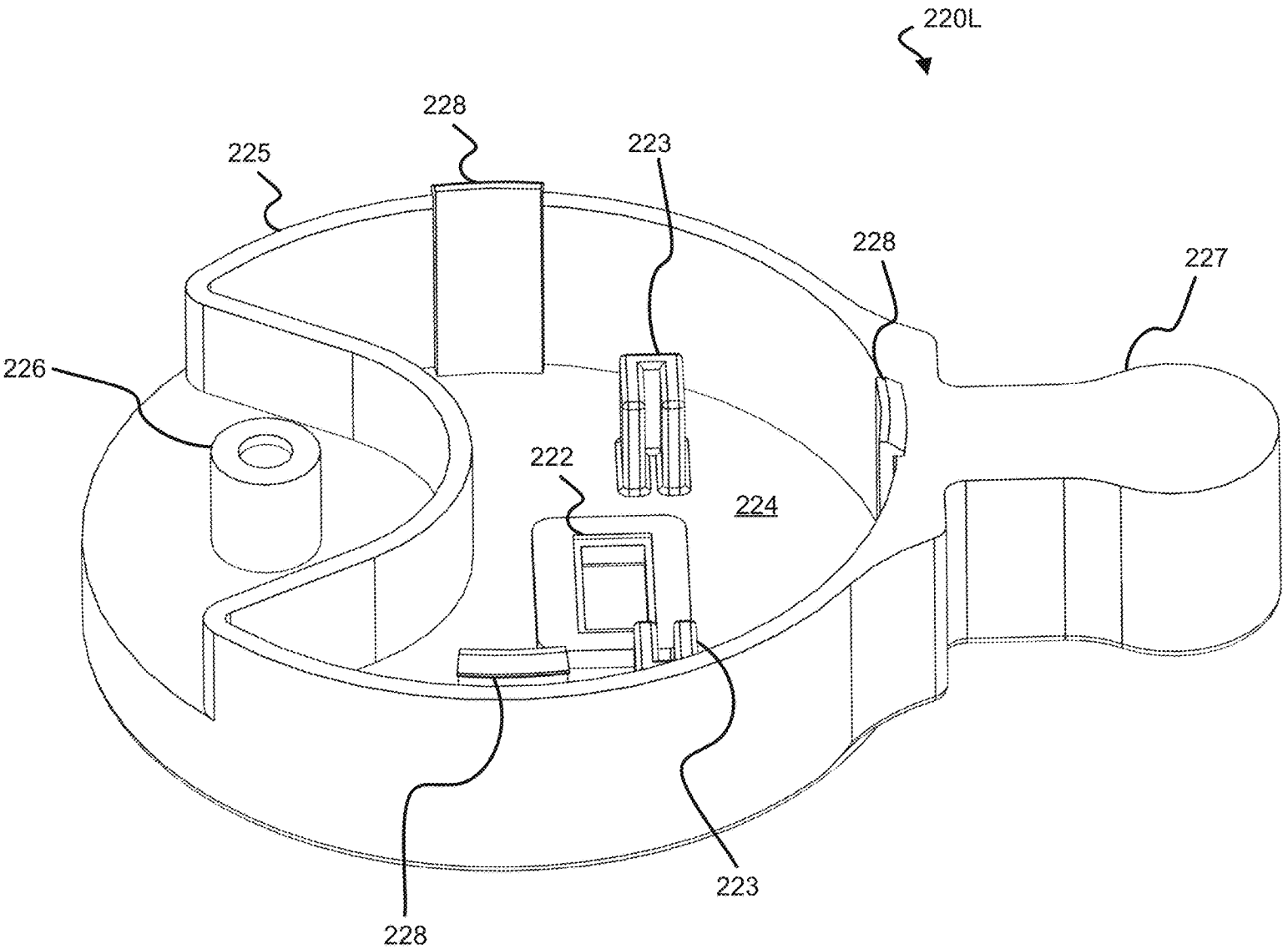
FIGS. 10A-10B show top (FIG. 10A) and bottom (FIG. 10B) perspective views of a lower hoist end cap of the hoist end member of FIGS. 8A-8B, in accordance with some examples of the present disclosure.
Figure 10B:
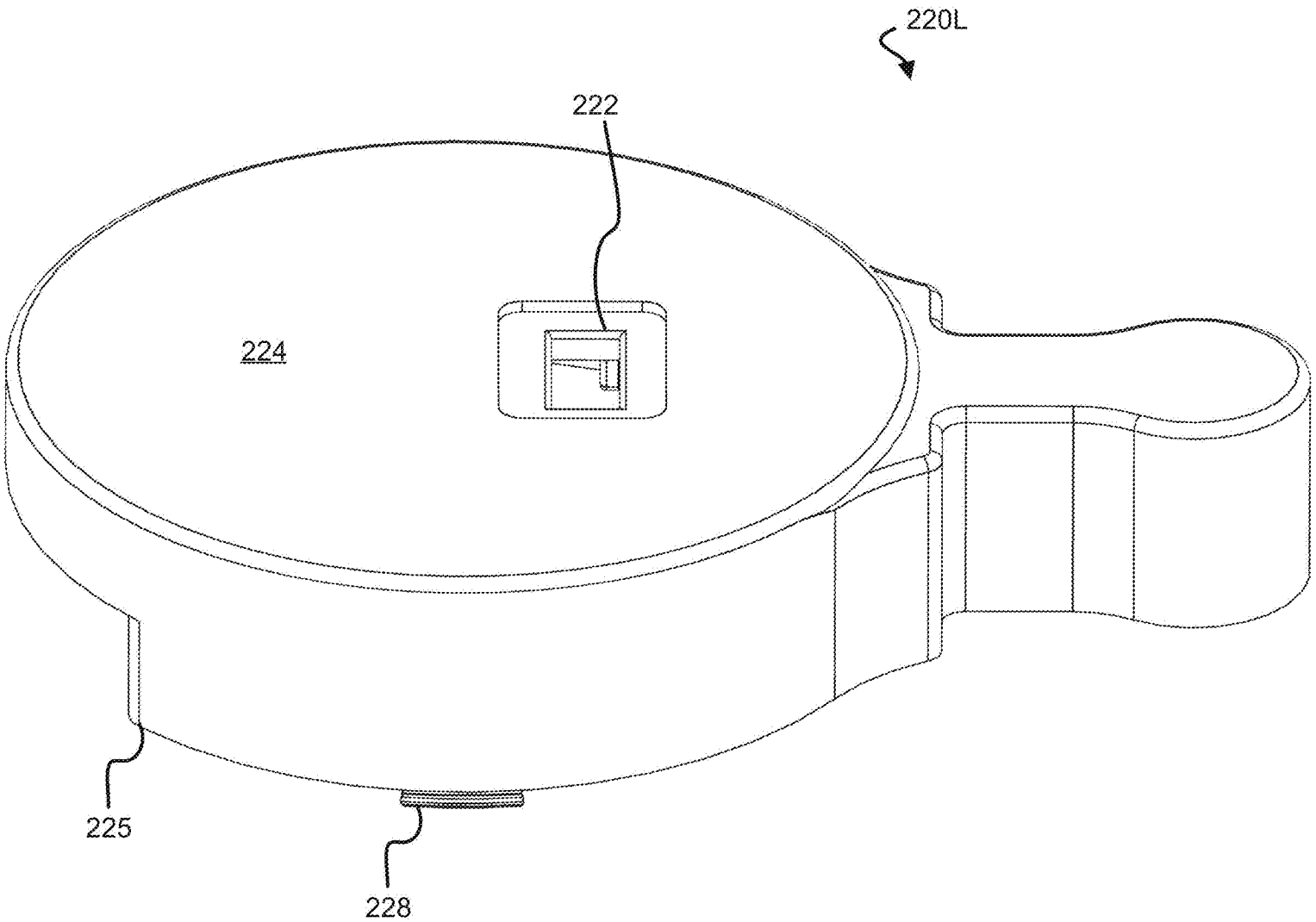

FIG. 10A is an illustration of an upper surface of a lower hoist end cap 220L, and FIG. 10*b* is an illustration of a lower surface of the lower hoist end cap 220L, in accordance with some examples of the present disclosure. As shown, lower hoist end cap 220L can include opening 222, mounting brackets 223, baseplate 224, sidewall 225, plug 226, tongue 227, and clips 228. Opening 222 is configured to provide an electrical connection, such as a USB connector, to components disposed within the flag frame. According to some embodiments, the lights of flag frame 200 can be powered by batteries, such as a battery (not shown) stored within the lower hoist end cap 220L, while in other embodiments, the lights of flag frame 200 can be powered by being connected to an electrical grid through wiring that runs through the flag frame 200 and into the base of flagpole 100 through opening 222. In yet other embodiments, the lights of flag frame 200 can be solar powered and connected to one or more external solar panels (not shown). Mounting brackets 223 of lower hoist end cap 220L are configured to fit into corresponding grooves of lower end 218 of hoist end member 210. The functions of baseplate 224, sidewall 225, plug 226, tongue 227, and clips 228 are substantially similar to those described with respect to upper hoist end cap 220U, and a full description is omitted here for brevity.

Figure 11B:
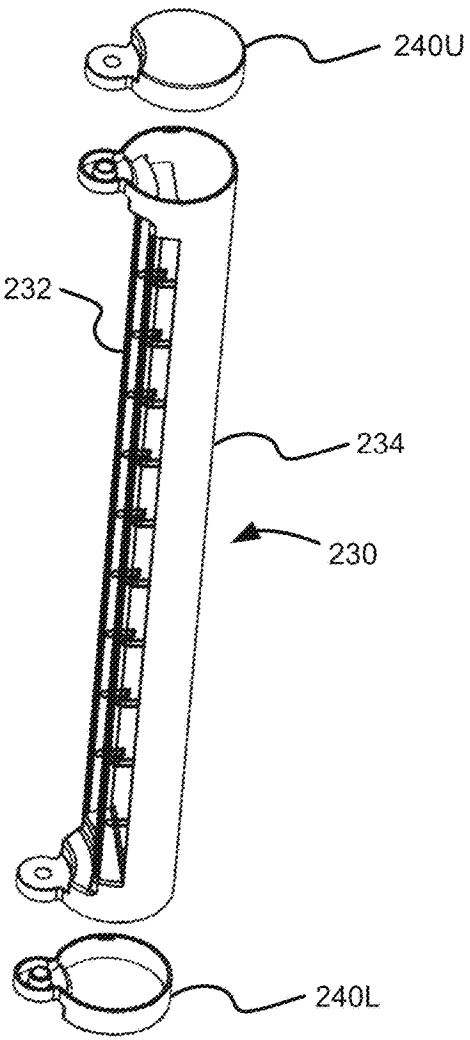
FIGS. 11A-11B show front (FIG. 11A) and side (FIG. 11A) exploded views of an exemplary fly end member of the flag frame of FIG. 7, in accordance with some examples of the present disclosure.
Figure 11A:
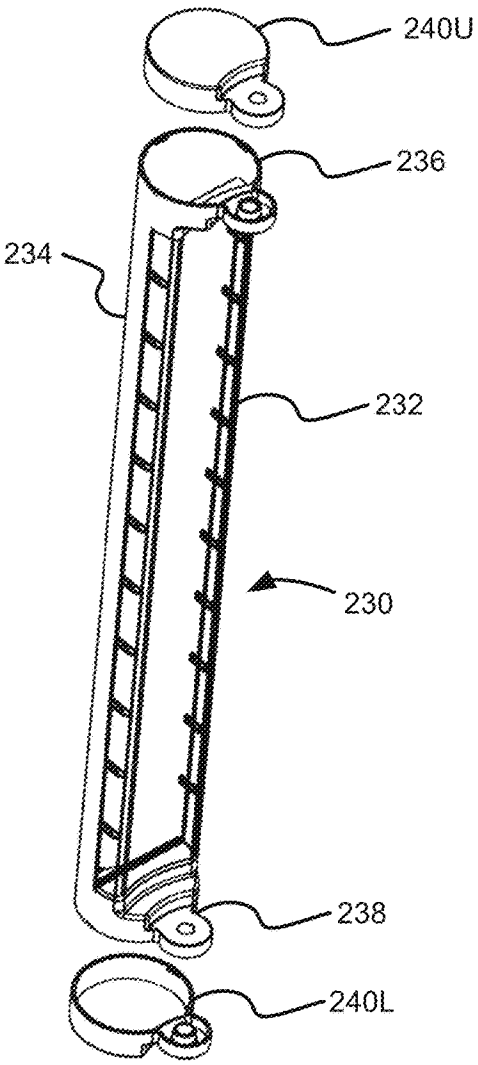

FIGS. 11A-11B are illustrations of a fly end member 230 of a flag frame 200, in accordance with some examples of the present disclosure. As shown, hoist end member 230 can include flag facing cavity 232, fly end outer body 234, upper end 236, and lower end 238. Flag facing cavity 232 can be configured to attach to a flag on a second side of the flag, opposite the first side of the flag, as discussed in reference to hoist end member 210. Fly end outer body 234 defines an outer frame of flag frame 200. Upper end 236 is configured to securely attach to an upper fly end cap 240U. Similarly, lower end 238 is configured to securely attach to a lower end cap 240L. According to some embodiments, fly end member can be configured to house one or more stackable links (not shown). Stackable links can be similar to swivel links 250, except they may be vertically stackable within hoist end member 210 and/or fly end member 230. As discussed with respect to swivel links 250, each stackable link may contain a light that is configured to illuminate a flag when attached to flag frame 200. Alternatively, a single light may be used in place of stackable links.

Figure 12A:
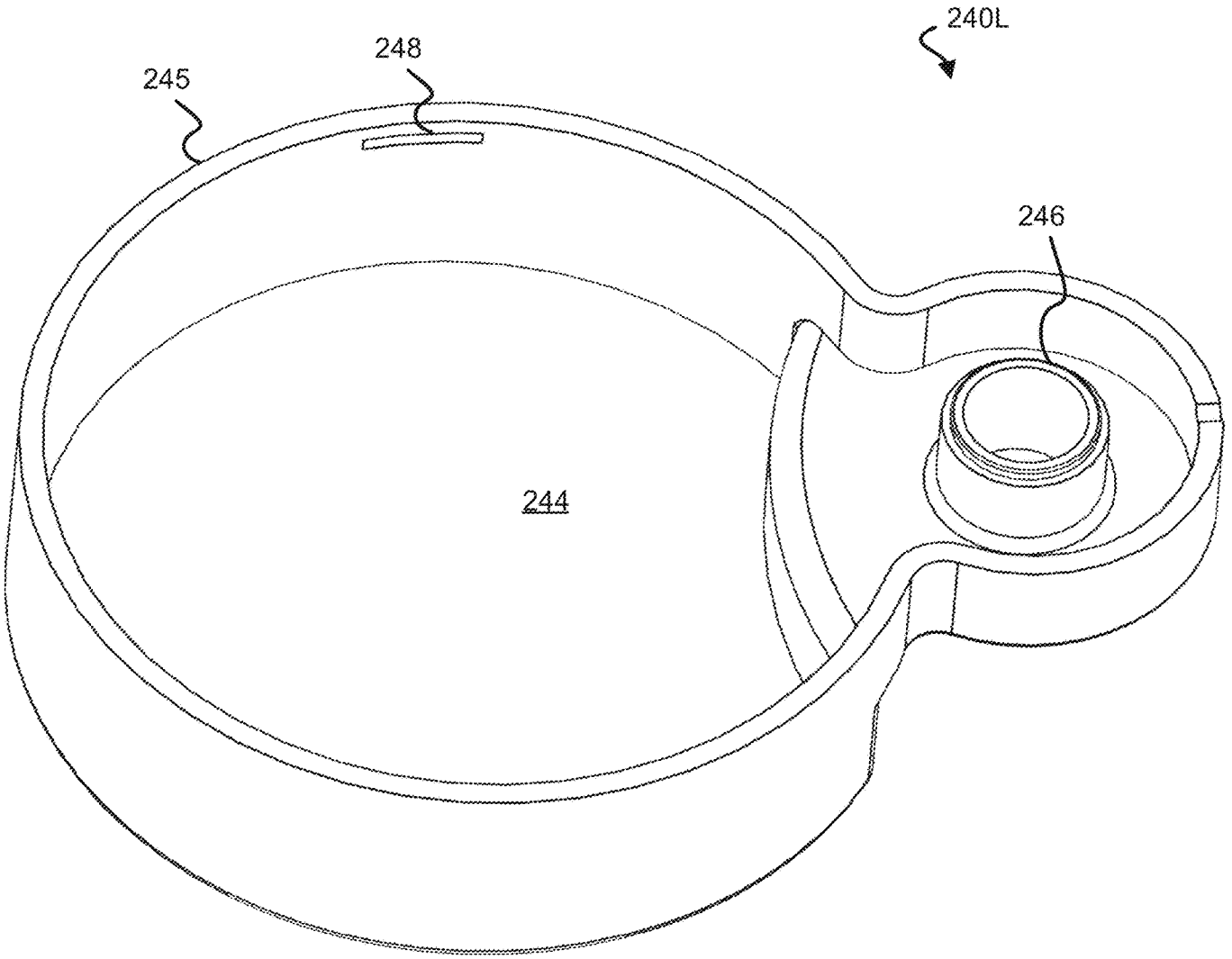
FIGS. 12A-12B show top (FIG. 12A) and bottom (FIG. 12B) perspective views of a lower fly end cap of the fly end member of FIGS. 11A-11B, in accordance with some examples of the present disclosure.
Figure 12B:
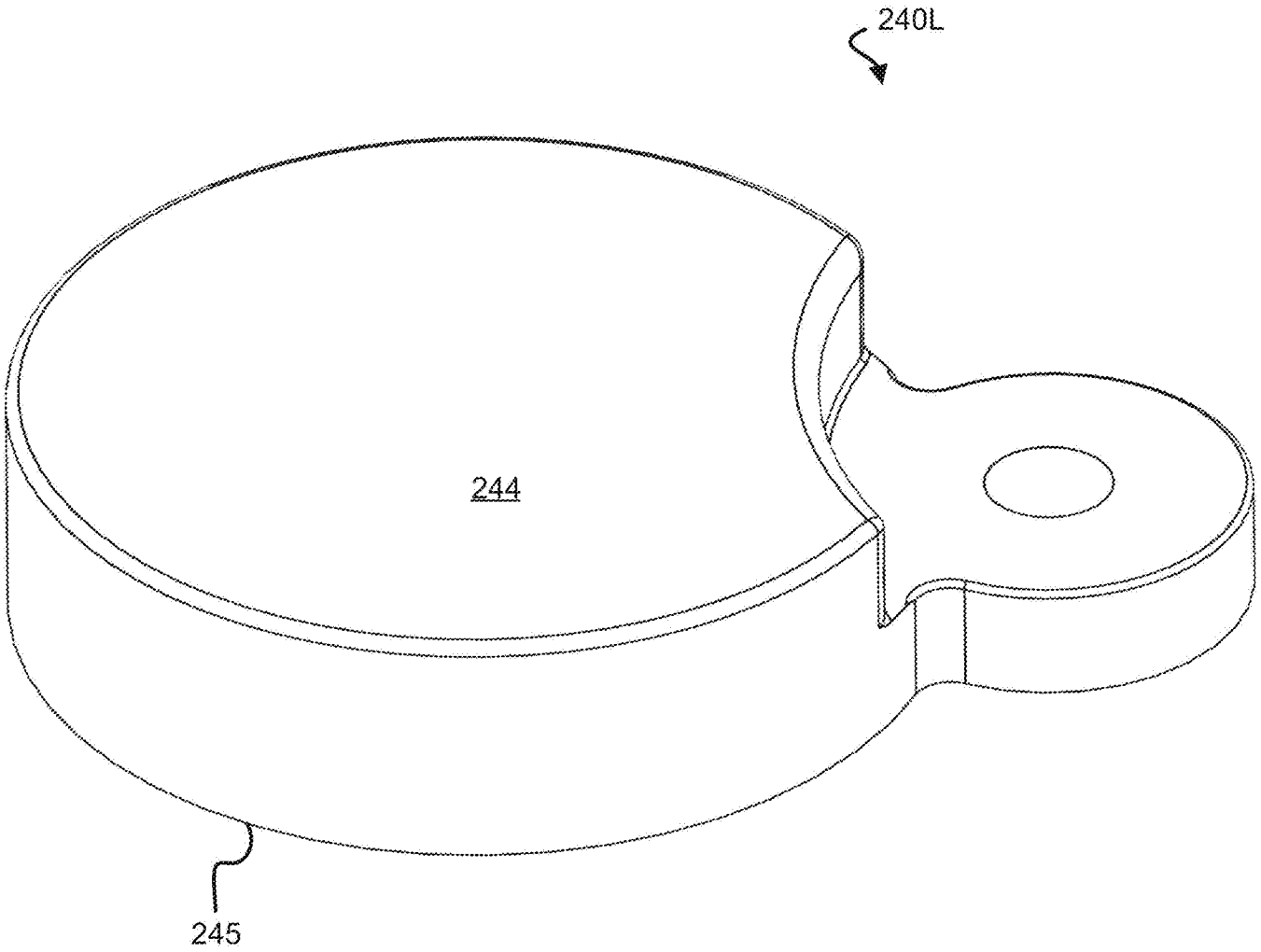

FIGS. 12A-12B are illustrations of a lower fly end cap 240L, in accordance with some examples of the present disclosure, with FIG. 12A showing an upper surface of lower fly end cap 240L and FIG. 12B showing a lower surface of lower fly end cap 240L. As shown in FIGS. 12A-12B, lower fly end cap 240L can include baseplate 244, sidewall 245, socket 246, and slots 248. Baseplate 244 is configured to seal an interior area of fly end member 230 when lower fly end cap 240L is fastened to lower end 238 of fly end member 230. Sidewall 245 can define a hollow space of the upper surface of lower fly end cap 240L which can interface with lower end 238 when upper hoist end cap 220U is attached to hoist end member 210. Socket 246 can be configured to snugly fit (e.g., an interference fit) with a corresponding plug located in lower end 238 of fly end member 230. Slots 248 can be configured to provide a groove for a corresponding clip (not shown) to interface with slot 248, thereby securing lower fly end cap 240L to lower end 238 of fly end member 230. Upper fly end cap 240U (not shown) may be substantially similar to or an inverted version of at least some of the features of 240L, and may include similar components of baseplate 244, sidewall 245, socket 246, and slots 248.

Figure 13A:
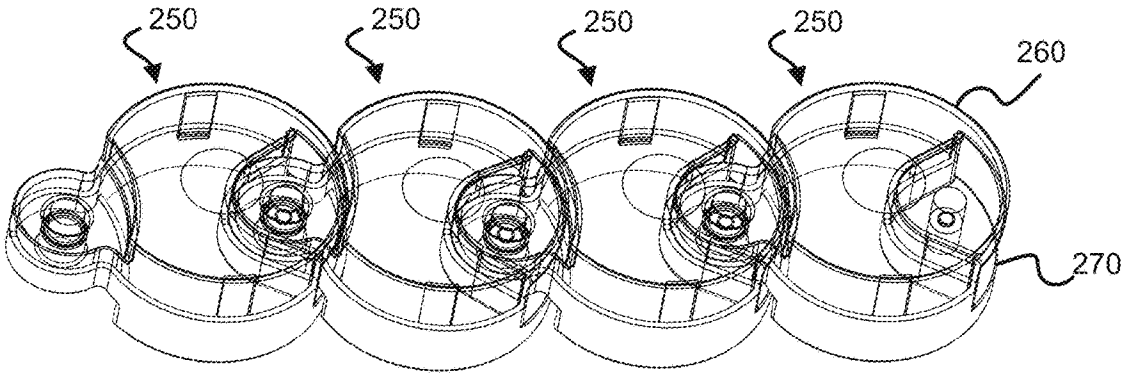
FIGS. 13A-13B show perspective views of a plurality of swivel links that are connected (FIG. 13A) and exploded (FIG. 13B), in accordance with some examples of the present disclosure.
Figure 13B:
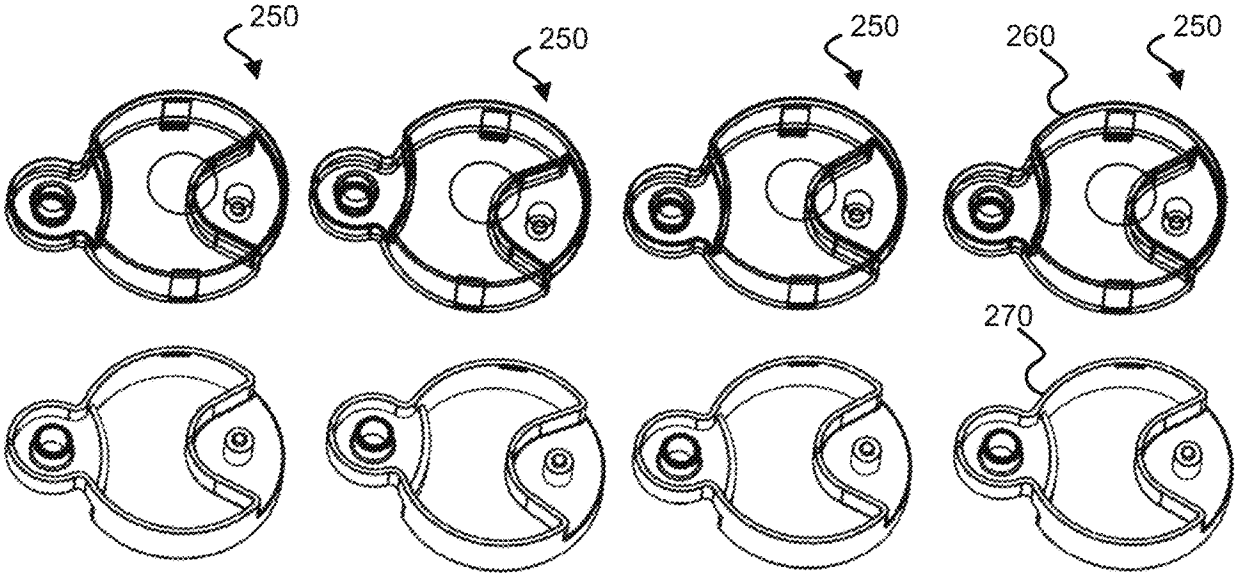

FIGS. 13A-13B are illustrations of a plurality of swivel links 250, each including an upper housing 260 and a lower housing 270, in accordance with some examples of the present disclosure. More specifically, FIG. 13A shows a chain of swivel links 250 attached to one another, while FIG. 13B shows an exploded view of the chain of swivel links 250. As shown, each swivel link is constructed of an upper housing 260 and a lower housing 270. The upper housings 260 can be constructed of a clear or light transmitting material, such as polycarbonate or other plastics. Embodiments with a clear material may help provide easier maintenance while a non-clear or opaque material may help provide a decorative aesthetic if the user does not wish to clearly see individual lights. Lower housing 270 can be generally opaque, light reflective, or light non-transmitting to help amplify the light omitted from upper housings 260, and can similarly be constructed of polycarbonate or a similar polymer material. Lower housing 260 is described in more detail with respect to FIGS. 14A-14B, and upper housing 270 is described in more detail with respect to FIGS. 15A-15B.

Figure 14A:
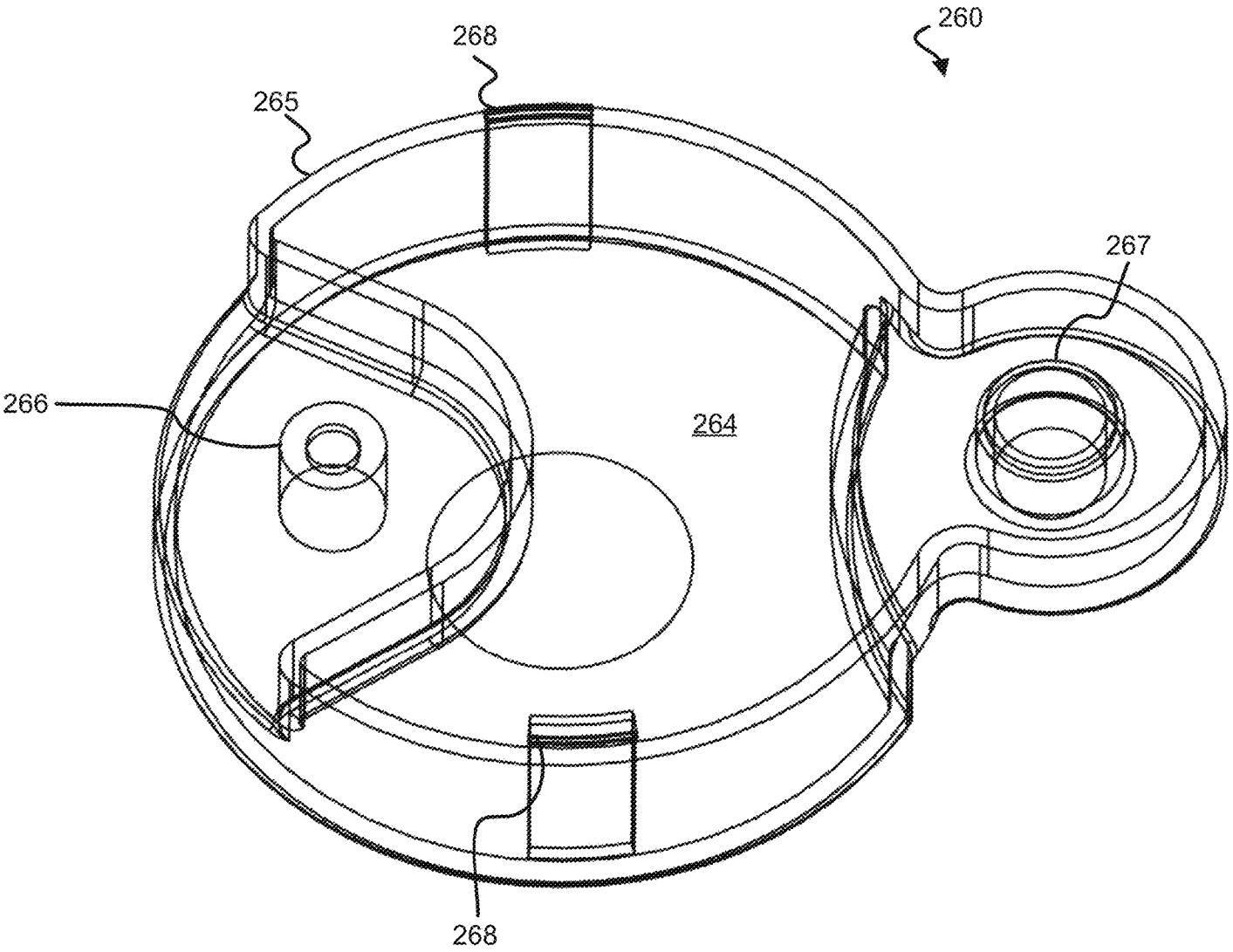
FIGS. 14A-14B show bottom (FIG. 14A) and top (FIG. 14B) perspective views of an upper housing of a swivel link of FIGS. 13A-13B, in accordance with some examples of the present disclosure.
Figure 14B:
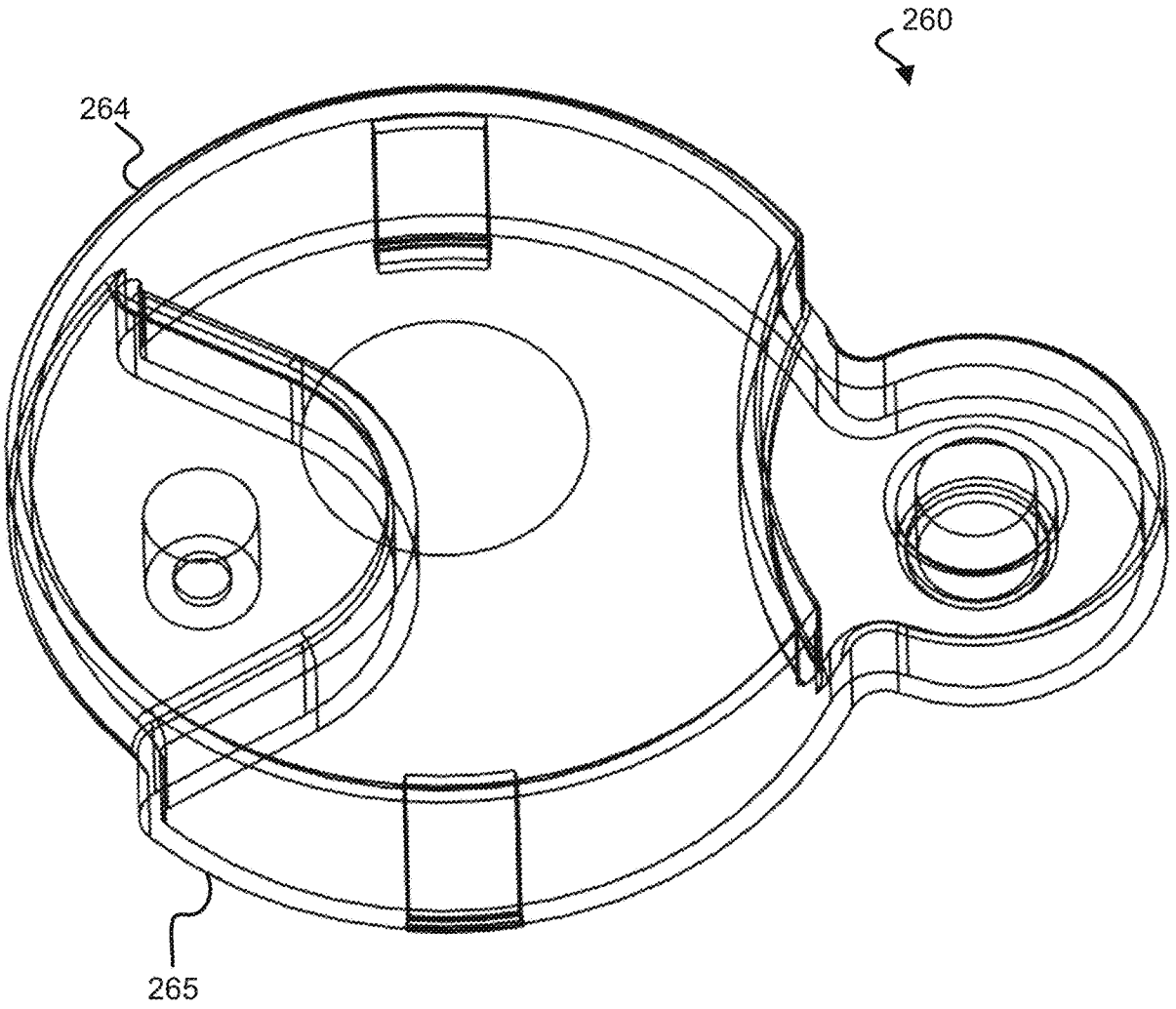

FIGS. 14A-14B are illustrations of an upper housing 260 of a swivel link 250, in accordance with some examples of the present disclosure. More specifically, FIG. 14A shows the lower side of upper housing 260, and FIG. 14B shows the corresponding upper side of upper housing 260. As shown in FIGS. 14A-14B, upper housing 260 can include baseplate 264, sidewall 265, plug 266, socket 267, and clips 268. Baseplate 264 of upper housing 260 and baseplate 274 (described in more detail with respect to FIGS. 15A-15B) of lower housing 270 can collectively form an interior space of swivel link 250. Plug 266 is configured to fit into corresponding sockets (e.g., socket 267 of upper housing 260 and socket 277 of a corresponding lower housing 270) of an adjacent swivel link 250. Socket 267 is similarly configured to fit a corresponding plug (e.g., plug 266 and plug 276) of a corresponding adjacent swivel link 250. Clips 268 are provided to secure the upper housing 260 to its corresponding lower housing 270 to form each swivel link 250. According to some embodiments, each swivel link 250 is configured to house one or more lights, which can be configured to illuminate a flag when the flag is attached to flag frame 200. Additionally, each swivel link can swivel with respect to an adjacent swivel by approximately 10 degrees in either direction (for a total of approximately 20 degrees of motion) in one example, or between approximately 5-15 degrees in another example. Additionally, the closest links (e.g., four or five) to the hoist end member 210 may be fixed in rotational alignment such that they do not rotate relative to one another. This helps with the rigidity of the flag frame 200 and helps it from collapsing while still appearing to have natural movement of a typical flag, and helps the flag frame 200 to appear fuller because the shape is better maintained. The swiveling feature of swivel links 250 allows the lights disposed within the upper cross member 280 and lower cross member 290 to mirror the motion of an attached flag as it is blown by wind, thereby continuously illuminating the flag in a consistent manner despite the motion of the flag, which is not possible with traditional illuminated flag systems because lighting from stationary light source(s) in traditional systems changes in intensity with the motion of the flag. Since the flag frame 200 does not sag, it provides consistent lighting over the entire body of the flag.

Figure 15A:
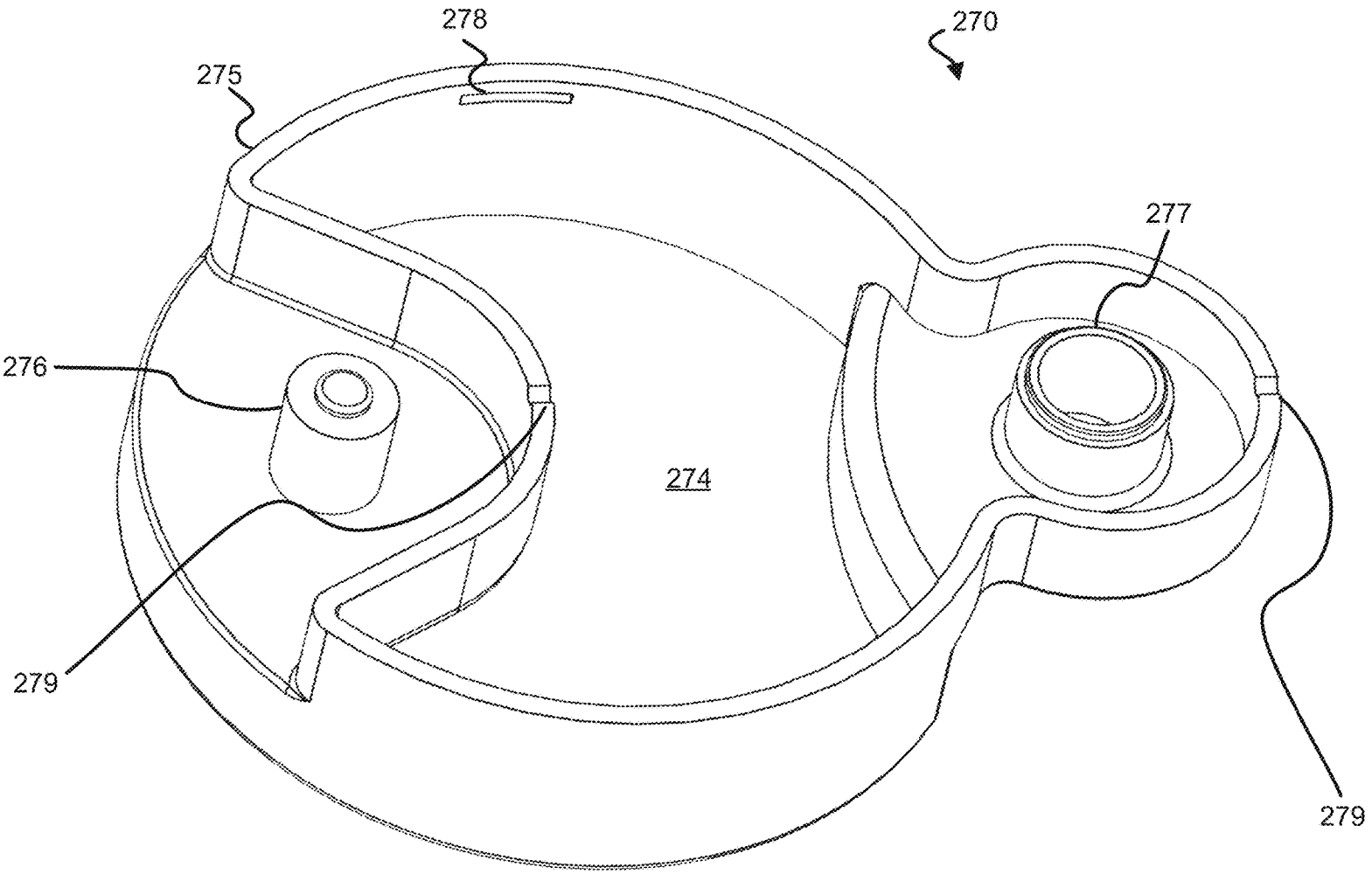
FIGS. 15A-15B show top (FIG. 15A) and bottom (FIG. 15B) perspective views of a lower housing of a swivel link of FIGS. 13A-13B, in accordance with some examples of the present disclosure.
Figure 15B:
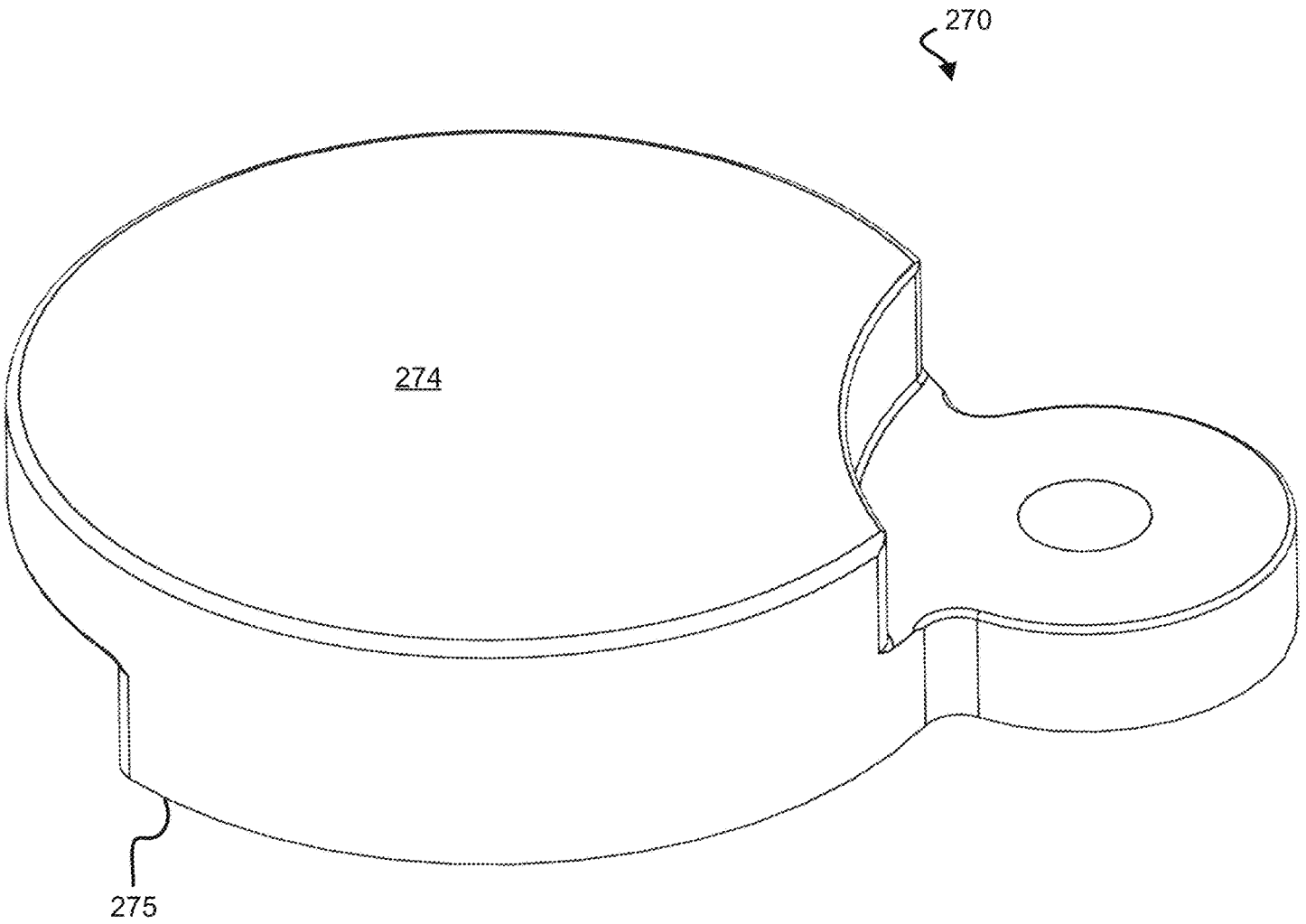

FIGS. 15A-15B are illustrations of a lower housing 270 of a swivel link 250, in accordance with some examples of the present disclosure. More specifically, FIG. 15A shows the upper side of lower housing 270, and FIG. 15B shows the corresponding lower side of lower housing 270. As shown, lower housing 270 can include baseplate 274, sidewall 275, plug 276, socket 277, slots 278, and wire groove 279. Plug 276 is configured to fit into corresponding sockets (e.g., socket 277 of lower housing 270 and socket 267 of a corresponding upper housing 260) of an adjacent swivel link 250. Slots 278 are configured to mate with clips 268 of a corresponding upper housing 260 to form each swivel link 250. Additionally, each lower housing 270 can include one or more wire grooves 279. Wire grooves 279 may be found in sidewall 275 and placed such that electrical wires can provide an electrical connection between each adjacent swivel link 250, thereby providing electrical power to the one or more lights housed within each swivel link 250. Additionally, in some embodiments, each wire groove 279 may be fitted with a grommet (not shown) in order to protect the electrical wires from physical damage, as well as seal swivel link 250 to be resistant to water, dust, and other elements.

Figure 16A:
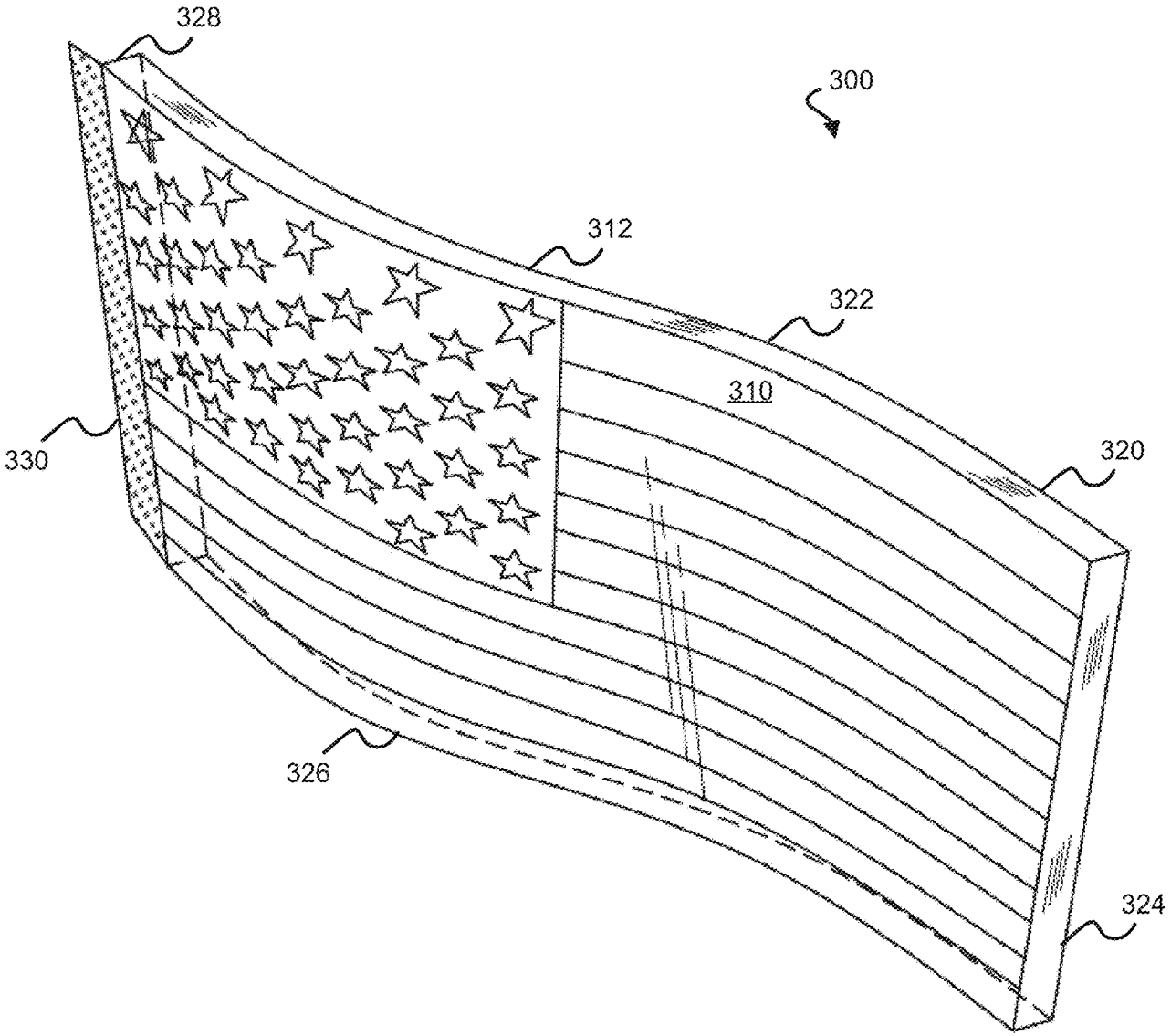
FIGS. 16A-16B show left front (FIG. 16A) and right front (FIG. 16B) isometric views of an exemplary flag that may be attached to the flag frame of FIG. 7, in accordance with some examples of the present disclosure.
Figure 16B:
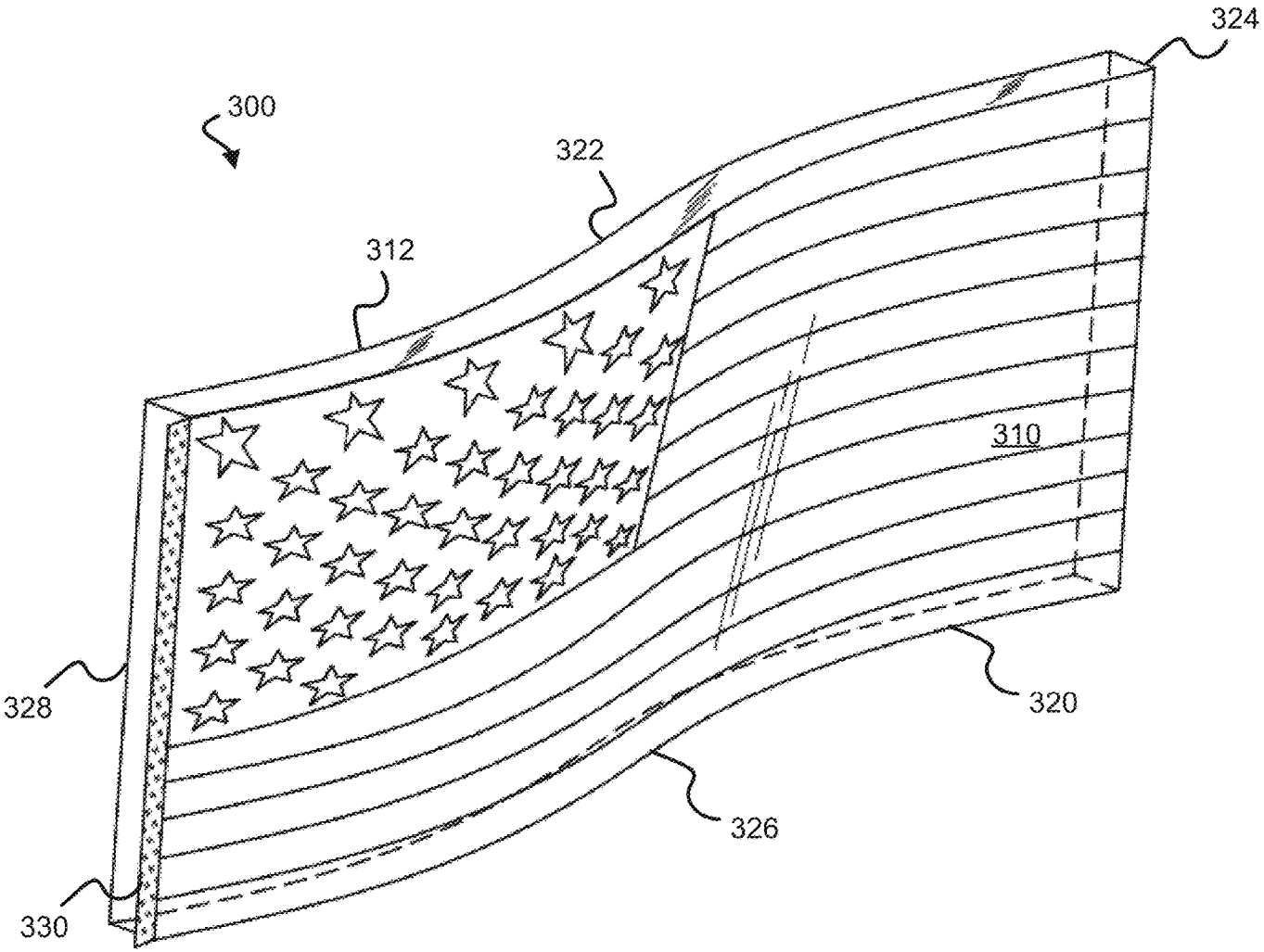
Figure 17:
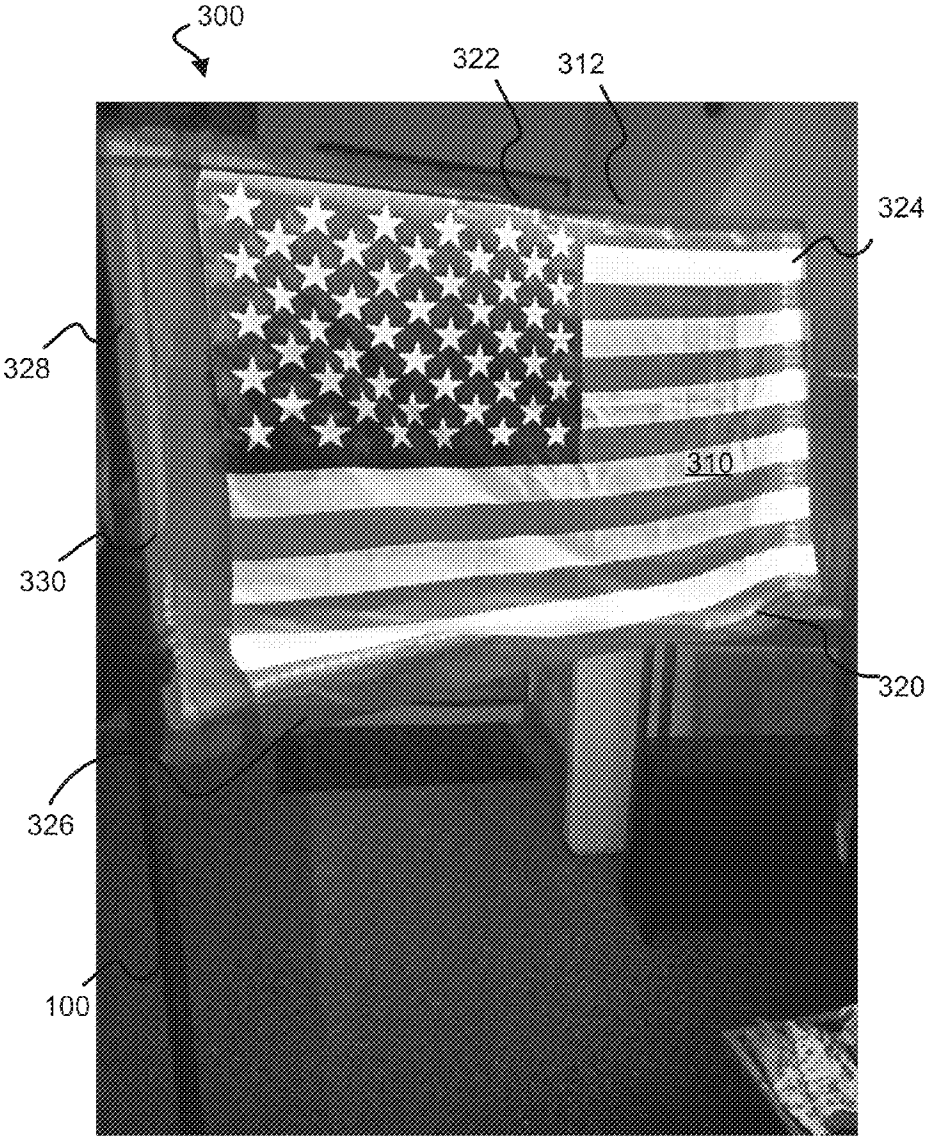
FIG. 17 shows a photograph of an exemplary flag that may be attached to the flag frame of FIG. 7, in accordance with some examples of the present disclosure.

FIGS. 16A-16B are illustrations of flag 300 from various perspectives, in accordance with some examples of the present disclosure. As shown, flag 300 can include front face 310, rear face 312, border 320, and attachment flap 330. Border 320 can include upper border member 322, fly end border member 324, lower border member 326, and hoist end border member 328. Flag 300 can be attached to flag facing cavity 212 of hoist end member 210 by attachment flap 330, with flag 300 being attached around an exterior of the flag frame 200. According to some embodiments, flag facing cavity 212 and attachment flap can include a hook and loop (e.g., Velcro™) system for attachment to the flag frame 200. Once flag 300 covers the flag frame 200, the flag frame 200 may light an entire interior perimeter of the flag 300. Accordingly, flag 300 can attach to hoist end member 210 by attaching hooks (or loops) of attachment flap 330 to respective loops (or hooks) found on flag facing cavity 212. When flag 300 is attached to flag frame 200, hoist end border member 328 may sit flush against hoist end member 210. Additionally, in embodiments including stackable links 450 (not shown) within hoist end member 210, stackable links 450 may illuminate flag 300. Similarly, when flag 300 is attached to flag frame 200, upper border member 322 may sit flush against upper cross member 280, which provides illumination to flag 300. Lower border 326 can sit flush against lower cross member 290. Chain links 250 of lower cross member 290 can illuminate flag 300. Fly end border member 324 can sit flush against fly end member 230. In embodiments including stackable links 450 within fly end member, lights within stackable links 450 can also illuminate flag 300. According to some embodiments, flag 300 can also be attached to flag frame 200 by an additional attachment flap 330 (not shown) disposed on fly end border member 324. The additional attachment flap 330 may include hooks (or loops) which interface with loops (or hooks) disposed on flag facing cavity 232 of fly end member 230. Because swivel links 250 can swivel with respect to adjacent swivel links 250, flag 300 can remain illuminated despite the flag's motion in the wind, because swivel links 250 can mirror the motion of flag 300. As further shown in FIG. 17, which depicts a photograph of flag 300, flag 300 may attach to flag frame 200, and the combined assembly of flag frame 200 and flag 300 may attach to flagpole 100. While flag 300 is attached around an exterior of flag frame 200, the swivel links 250 may illuminate front face 310, rear face 312, and border 320. Additionally, hoist end member and fly end member 230 may provide additional illumination of flag 300, including front face 310, rear face 312, and border 320. In some embodiments, flag frame 200 may be attached to an ordinary flag that lacks attachment flap 330. For example, a flag may be positioned and secured to an interior space of flag frame 200, rather than being attached around an exterior of flag frame 200 as with flag 300. In such embodiments, the flag may be illuminated on both a front face and a rear face of the flag by lights located within optional stackable links 450, chain links 250 of upper cross member 280, and chain links 250 of lower cross member 290.

Examples of the present disclosure can be implemented according to at least the following clauses:

Clause 1: An illuminated flagpole assembly comprising a flag frame, the flag frame comprising: a hoist end member configured to be selectively attached to a flagpole; a fly end member aligned in parallel with and opposite to the hoist end member; an upper cross member formed by a first plurality of links each connected to and configured to swivel relative to one or more adjacent links of the first plurality of links, the first plurality of links aligned along a first plane and comprising a first link connected to the hoist end member and a second link connected to the fly end member, wherein each link in the first plurality of links comprises a housing; a first plurality of light elements each having at least a portion of which disposed within the housing of a respective link of the first plurality of links; a lower cross member formed by a second plurality of links each connected to and configured to swivel relative to one or more adjacent links of the second plurality of links, the second plurality of links aligned along a second plane parallel to the first plane and comprising a first link connected to the hoist end member and a second link connected to the fly end member, wherein each link in the second plurality of links comprises a housing; and a second plurality of light elements each having at least a portion of which disposed within the housing of a respective link of the second plurality of links.

Clause 2: The illuminated flagpole assembly of clause 1 further comprising the flagpole attached to the hoist end member.

Clause 3: The illuminated flagpole assembly of clause 2, wherein: the hoist end member has an attachment sleeve; and the flagpole further has a tubular body having an attachment section and an extension section, the attachment section of the tubular body defining an opening configured to slidably receive at least a portion of the attachment sleeve of the hoist end member.

Clause 4: The illuminated flagpole assembly of clause 1 further comprising a flag having a front face opposite a back face and a plurality of sides, at least a portion of a first side of the plurality of sides configured to attach to the hoist end member, and at least a portion of a second side of the plurality of sides configured to attach to the fly end member.

Clause 5: The illuminated flagpole assembly of clause 4, wherein the flag is readily attachable to and detachable from the flag frame.

Clause 6: The illuminated flagpole assembly of clause 4, wherein the first and second pluralities of light elements are collectively configured to simultaneously illuminate the front and back faces of the flag when it is attached to the flag frame.

Clause 7: The illuminated flagpole assembly of clause 4, wherein responsive to movement of the flag when the flag is attached to the flag frame: each of the first plurality of links of the upper cross member is configured to swivel relative to the one or more adjacent links of the first plurality of links along the first plane to mirror the movement of the flag; and each of the second plurality of links of the lower cross member is configured to swivel relative to the one or more adjacent links of the second plurality of links along the second plane to mirror the movement of the flag.

Clause 8: An illuminated flagpole assembly comprising a flag frame, the flag frame comprising: a hoist end member; a fly end member positioned opposite the hoist end member; an upper cross member attachable to the hoist end member at a first end and to the fly end member at a second end, the upper cross member being formed by a first plurality of links aligned along a first plane, each of the first plurality of links being attachable and configured to rotate in the first plane relative to one or more adjacent links of the first plurality of links; a first plurality of light elements each attachable to a respective link of the first plurality of links; a lower cross member attachable to the hoist end member at a first end and to the fly end member at a second end, the lower cross member being formed by a second plurality of links aligned along a second plane parallel to the first plane, each of the second plurality of links being attachable and configured to rotate in the second plane relative to one or more adjacent links of the second plurality of links; and a second plurality of light elements each attachable to a respective link of the second plurality of links.

Clause 9: The illuminated flagpole assembly of clause 8 further comprising a flagpole attached to the hoist end member.

Clause 10: The illuminated flagpole of assembly of clause 9, wherein: the hoist end member comprises an attachment sleeve; the flagpole comprises a tubular body comprising an attachment section and an extension section, the attachment section of the tubular body comprising an opening configured to slideably connect to at least a portion of the attachment sleeve of the hoist end member.

Clause 11: The illuminated flagpole assembly of clause 8 further comprising a flag, the flag comprising a front face opposite a back face, and a plurality of side faces, wherein a first side face of the plurality of side faces is configured to attach to the hoist end member, and a second side face of the plurality of side faces is configured to attach to the fly end member.

Clause 12: The illuminated flagpole assembly of clause 11, wherein the flag is readily attachable to and detachable from the flag frame.

Clause 13: The illuminated flagpole assembly of clause 11, wherein the first and second pluralities of light elements are collectively configured to simultaneously illuminate the front and back faces of the flag when the flag is attached to the flag frame.

Clause 14: The illuminated flagpole assembly of clause 11, wherein responsive to movement of the flag when the flag is attached to the flag frame: each of the first plurality of links of the upper cross member is configured to swivel relative to the one or more adjacent links of the first plurality of links along the first plane to mirror the movement of the flag; and each of the second plurality of links of the lower cross member is configured to swivel relative to the one or more adjacent links of the second plurality of links along the second plane to mirror the movement of the flag.

Clause 15: An illuminated flagpole assembly comprising a flag frame, the flag frame comprising: a hoist end member; a fly end member positioned opposite the hoist end member; an upper cross member attachable to the hoist end member at a first end and to the fly end member at a second end, the upper cross member comprising a first plurality of links, the first plurality of links each connected to one or more adjacent links of the first plurality of links, the first plurality of links aligned along a first plane and configured to swivel with respect to one or more adjacent links of the first plurality of links; a first plurality of light elements each attachable to a respective link of the first plurality of links; a lower cross member attachable to the hoist end member at a first end and to the fly end member at a second end, the lower cross member comprising a second plurality of links, the second plurality of links each connected to one or more adjacent links of the second plurality of links, the second plurality of links each connected to one or more adjacent links of the second plurality of links, the second plurality of links aligned along a second plane parallel to the first plane and configured to swivel with respect to one or more adjacent links of the second plurality of links; and a second plurality of light elements each attachable to a respective link of the second plurality of links.

Clause 16: The illuminated flagpole assembly of clause 15, wherein: the hoist end member comprises a third plurality of links, the third plurality of links each connected to one or more adjacent links of the third plurality of links, the third plurality of links aligned along a third plane perpendicular to the first and second planes and configured to swivel with respect to one or more adjacent links of the third plurality of links; and the fly end member comprises a fourth plurality of links, the fourth plurality of links each connected to one or more adjacent links of the fourth plurality of links, the fourth plurality of links aligned along a fourth plane parallel to the third plane and configured to swivel with respect to one or more adjacent links of the third plurality of links.

Clause 17: The illuminated flagpole assembly of clause 15, further comprising: a flagpole comprising a tubular body comprising an attachment section and an extension section, the attachment section of the tubular body comprising an opening configured to slideably connect to at least a portion of an attachment sleeve of the hoist end member.

Clause 18: The illuminated flagpole assembly of clause 15 further comprising a flag, the flag comprising a front face opposite a back face, and a plurality of side faces, wherein a first side face of the plurality of side faces is configured to attach to the hoist end member, and a second side face of the plurality of side faces is configured to attach to the fly end member.

Clause 19: The illuminated flagpole assembly of clause 18, wherein the first and second pluralities of light elements are collectively configured to simultaneously illuminate the front and back faces of the flag when the flag is attached to the flag frame.

Clause 20: The illuminated flagpole assembly of clause 18, wherein responsive to movement of the flag when the flag is attached to the flag frame: each of the first plurality of links of the upper cross member is configured to swivel relative to the one or more adjacent links of the first plurality of links along the first plane to mirror the movement of the flag; and each of the second plurality of links of the lower cross member is configured to swivel relative to the one or more adjacent links of the second plurality of links along the second plane to mirror the movement of the flag.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It is also to be understood that the mention of one or more method steps does not imply a particular order of operation or preclude the presence of additional method steps or intervening method steps between those steps expressly identified. Similarly, it is also to be understood that the mention of one or more components in a device or system does not preclude the presence of additional components or intervening components between those components expressly identified.

What is claimed is:

1. An illuminated flagpole assembly comprising a flag frame, the flag frame comprising:

a hoist end member configured to be selectively attached to a flagpole;

a fly end member aligned in parallel with and opposite to the hoist end member;

an upper cross member formed by a first plurality of links each connected to one or more adjacent links of the first plurality of links, the first plurality of links aligned along a first plane and comprising a first link connected to the hoist end member and a second link connected to the fly end member;

a first plurality of light elements attachable to a respective link of the first plurality of links;

a lower cross member formed by a second plurality of links each connected to one or more adjacent links of the second plurality of links, the second plurality of links aligned along a second plane parallel to the first plane and comprising a first link connected to the hoist end member and a second link connected to the fly end member; and a second plurality of light elements attachable to a respective link of the second plurality of links.

2. The illuminated flagpole assembly of claim 1 further comprising the flagpole attached to the hoist end member.

3. The illuminated flagpole assembly of claim 2, wherein:

the hoist end member has an attachment sleeve; and the flagpole further has a tubular body having an attachment section and an extension section, the attachment section of the tubular body defining an opening configured to slidably receive at least a portion of the attachment sleeve of the hoist end member.

4. The illuminated flagpole assembly of claim 1 further comprising a flag having a front face opposite a back face and a plurality of sides, at least a portion of a first side of the plurality of sides configured to attach to the hoist end member, and at least a portion of a second side of the plurality of sides configured to attach to the fly end member.

5. The illuminated flagpole assembly of claim 4, wherein the flag is readily attachable to and detachable from the flag frame.

6. The illuminated flagpole assembly of claim 4, wherein the first and second pluralities of light elements are collectively configured to simultaneously illuminate the front and back faces of the flag when it is attached to the flag frame.

7. The illuminated flagpole assembly of claim 4, wherein responsive to movement of the flag when the flag is attached to the flag frame:

each of the first plurality of links of the upper cross member is configured to swivel relative to the one or more adjacent links of the first plurality of links along the first plane to mirror the movement of the flag; and each of the second plurality of links of the lower cross member is configured to swivel relative to the one or more adjacent links of the second plurality of links along the second plane to mirror the movement of the flag.

8. An illuminated flagpole assembly comprising a flag frame, the flag frame comprising:

a hoist end member;

a fly end member positioned opposite the hoist end member;

an upper cross member attachable to the hoist end member at a first end and to the fly end member at a second end, the upper cross member being formed by a first plurality of links aligned along a first plane;

a first plurality of light elements each attachable to a respective link of the first plurality of links;

a lower cross member attachable to the hoist end member at a first end and to the fly end member at a second end, the lower cross member being formed by a second plurality of links aligned along a second plane parallel to the first plane; and a second plurality of light elements each attachable to a respective link of the second plurality of links.

9. The illuminated flagpole assembly of claim 8 further comprising a flagpole attached to the hoist end member.

10. The illuminated flagpole of assembly of claim 9, wherein:

the hoist end member comprises an attachment sleeve;

the flagpole comprises a tubular body comprising an attachment section and an extension section, the attachment section of the tubular body comprising an opening configured to slideably connect to at least a portion of the attachment sleeve of the hoist end member.

11. The illuminated flagpole assembly of claim 8 further comprising a flag, the flag comprising a front face opposite a back face, and a plurality of side faces, wherein a first side face of the plurality of side faces is configured to attach to the hoist end member, and a second side face of the plurality of side faces is configured to attach to the fly end member.

12. The illuminated flagpole assembly of claim 11, wherein the flag is readily attachable to and detachable from the flag frame.

13. The illuminated flagpole assembly of claim 11, wherein the first and second pluralities of light elements are collectively configured to simultaneously illuminate the front and back faces of the flag when the flag is attached to the flag frame.

14. The illuminated flagpole assembly of claim 11, wherein responsive to movement of the flag when the flag is attached to the flag frame:

each of the first plurality of links of the upper cross member is configured to swivel relative to the one or more adjacent links of the first plurality of links along the first plane to mirror the movement of the flag; and each of the second plurality of links of the lower cross member is configured to swivel relative to the one or more adjacent links of the second plurality of links along the second plane to mirror the movement of the flag.

15. An illuminated flagpole assembly comprising a flag frame, the flag frame comprising:

a hoist end member;

a fly end member positioned opposite the hoist end member;

an upper cross member attachable to the hoist end member at a first end and to the fly end member at a second end, the upper cross member comprising a first plurality of links connecting the hoist end member to the fly end member, the first plurality of links aligned along a first plane;

a first plurality of light elements each attachable to a respective link of the first plurality of links;

a lower cross member attachable to the hoist end member at a first end and to the fly end member at a second end, the lower cross member comprising a second plurality of links connecting the hoist end member to the fly end member, the second plurality of links aligned along a second plane parallel to the first plane; and a second plurality of light elements each attachable to a respective link of the second plurality of links.

16. The illuminated flagpole assembly of claim 15, wherein:

the hoist end member comprises a third plurality of links, the third plurality of links each connected to one or more adjacent links of the third plurality of links, the third plurality of links aligned along a third plane perpendicular to the first and second planes and configured to swivel with respect to one or more adjacent links of the third plurality of links; and the fly end member comprises a fourth plurality of links, the fourth plurality of links each connected to one or more adjacent links of the fourth plurality of links, the fourth plurality of links aligned along a fourth plane parallel to the third plane and configured to swivel with respect to one or more adjacent links of the third plurality of links.

17. The illuminated flagpole assembly of claim 15, further comprising:

a flagpole comprising a tubular body comprising an attachment section and an extension section, the attachment section of the tubular body comprising an opening configured to slideably connect to at least a portion of an attachment sleeve of the hoist end member.

18. The illuminated flagpole assembly of claim 15 further comprising a flag, the flag comprising a front face opposite a back face, and a plurality of side faces, wherein a first side face of the plurality of side faces is configured to attach to the hoist end member, and a second side face of the plurality of side faces is configured to attach to the fly end member.

19. The illuminated flagpole assembly of claim 18, wherein the first and second pluralities of light elements are collectively configured to simultaneously illuminate the front and back faces of the flag when the flag is attached to the flag frame.

20. The illuminated flagpole assembly of claim 18, wherein responsive to movement of the flag when the flag is attached to the flag frame:

each of the first plurality of links of the upper cross member is configured to swivel relative to the one or more adjacent links of the first plurality of links along the first plane to mirror the movement of the flag; and each of the second plurality of links of the lower cross member is configured to swivel relative to the one or more adjacent links of the second plurality of links along the second plane to mirror the movement of the flag.

* * * * *